US010920597B2

(12) United States Patent
Meier et al.

(10) Patent No.: US 10,920,597 B2
(45) Date of Patent: Feb. 16, 2021

(54) TURBINE BLADE COOLING SYSTEM WITH CHANNEL TRANSITION

(71) Applicant: Solar Turbines Incorporated, San Diego, CA (US)

(72) Inventors: Andrew T. Meier, San Diego, CA (US); Nnawuihe Okpara, San Diego, CA (US); Stephen Edward Pointon, Santee, CA (US)

(73) Assignee: Solar Turbines Incorporated, San Diego, CA (US)

( * ) Notice: Subject to any disclaimer, the term of this patent is extended or adjusted under 35 U.S.C. 154(b) by 61 days.

(21) Appl. No.: 16/125,550

(22) Filed: Sep. 7, 2018

(65) Prior Publication Data

US 2020/0024968 A1 Jan. 23, 2020

Related U.S. Application Data

(60) Provisional application No. 62/598,363, filed on Dec. 13, 2017.

(51) Int. Cl.

| | |
|---|---|
| ***F01D 5/08*** | (2006.01) |
| ***F01D 5/18*** | (2006.01) |
| ***F01D 5/14*** | (2006.01) |
| ***F01D 5/30*** | (2006.01) |

(52) U.S. Cl.

CPC ..... *F01D 5/187* (2013.01); *F01D 5/081* (2013.01); *F01D 5/147* (2013.01); *F01D 5/186* (2013.01); *F01D 5/3007* (2013.01); *F05D 2230/21* (2013.01); *F05D 2230/211* (2013.01); *F05D 2240/12* (2013.01); *F05D 2240/301* (2013.01); *F05D 2240/305* (2013.01); *F05D 2240/81* (2013.01); *F05D 2250/185* (2013.01); *F05D 2250/324* (2013.01); *F05D 2260/201* (2013.01); *F05D 2260/202* (2013.01); *F05D 2260/2212* (2013.01); *F05D 2260/22141* (2013.01)

(58) Field of Classification Search

CPC ..... F01D 5/187; F01D 5/081; F01D 5/085; F01D 5/147; F01D 5/3007; F05D 2240/12; F05D 2240/301; F05D 2250/185; F05D 2250/324; F05D 2260/201; F05D 2260/202; F05D 2260/2212; F05D 2260/22141

See application file for complete search history.

(56) References Cited

U.S. PATENT DOCUMENTS 4,474,532 A * 10/1984 Pazder ..... F01D 5/187 415/115
4,676,719 A 6/1987 Auxier et al.
5,395,212 A * 3/1995 Anzai ..... F01D 5/187 415/115

(Continued)

FOREIGN PATENT DOCUMENTS

WO 2014052832 4/2014

*Primary Examiner* — Christopher Verdier
*Assistant Examiner* — Theodore C Ribadeneyra
(74) *Attorney, Agent, or Firm* — Procopio, Cory, Hargreaves & Savitch LLP

(57) ABSTRACT

A turbine blade having a base and an airfoil, the base including cooling air inlets and an internal cooling air passageway, and the airfoil including an internal multi-bend heat exchange path beginning at the base and ending at a cooling air outlet at the trailing edge of the airfoil. The airfoil also includes a "skin" that encompasses a tip wall, an inner spar, and a tip flag cooling system.

20 Claims, 12 Drawing Sheets

(56) References Cited

U.S. PATENT DOCUMENTS 5,403,159 A * 4/1995 Green ..... F01D 5/187 416/97 R
5,462,405 A * 10/1995 Hoff ..... F01D 5/187 415/115
5,538,394 A 7/1996 Inomata et al.
5,599,166 A * 2/1997 Deptowicz ..... B22C 9/04 164/369
5,902,093 A * 5/1999 Liotta ..... F01D 5/20 415/115
6,220,817 B1 * 4/2001 Durgin ..... F01D 5/187 415/115
6,227,804 B1 * 5/2001 Koga ..... F01D 5/187 415/115
6,257,831 B1 * 7/2001 Papple ..... B22C 9/10 416/97 R
6,974,306 B2 12/2005 Djeridane et al.
6,974,308 B2 * 12/2005 Halfmann ..... B22C 9/04 415/115
7,028,487 B2 4/2006 Marushima et al.
7,094,031 B2 * 8/2006 Lee ..... F01D 5/187 416/97 R
7,137,784 B2 * 11/2006 Hall ..... F01D 5/187 416/97 R
7,186,082 B2 * 3/2007 Mongillo, Jr. ..... F01D 5/187 416/1
7,296,973 B2 11/2007 Lee et al.
7,413,407 B2 * 8/2008 Liang ..... F01D 5/186 416/97 R
7,442,008 B2 * 10/2008 Kopmels ..... F01D 5/18 416/191
7,607,891 B2 * 10/2009 Cherolis ..... F01D 5/187 415/115
7,611,330 B1 * 11/2009 Liang ..... F01D 5/187 416/97 R
7,625,178 B2 * 12/2009 Morris ..... F01D 5/187 29/889.7
7,665,968 B2 * 2/2010 Mongillo, Jr. ..... F01D 5/187 416/97 R
7,674,093 B2 * 3/2010 Lee ..... B22C 9/103 164/365
7,690,894 B1 * 4/2010 Liang ..... F01D 5/186 415/115
7,901,181 B1 * 3/2011 Liang ..... F01D 5/186 416/97 R
7,967,566 B2 * 6/2011 Liang ..... F01D 5/187 416/97 R
7,985,049 B1 7/2011 Liang
8,172,533 B2 * 5/2012 Pinero ..... F01D 5/187 416/97 R
8,413,709 B2 * 4/2013 Lee ..... B22C 9/101 164/361
8,562,295 B1 * 10/2013 Liang ..... F01D 5/14 29/889.21
8,591,189 B2 * 11/2013 Correia ..... F01D 5/187 416/96 R
8,613,597 B1 * 12/2013 Liang ..... F01D 5/187 416/97 R
8,944,763 B2 * 2/2015 Lee ..... F01D 5/087 416/97 R
9,157,329 B2 * 10/2015 Nadeau ..... F01D 5/187
9,206,695 B2 * 12/2015 Pointon ..... F01D 5/186
9,228,439 B2 * 1/2016 Pointon ..... F01D 5/186
9,388,699 B2 * 7/2016 Dong ..... F01D 5/187
10,119,405 B2 * 11/2018 Weber ..... F01D 5/147
10,174,620 B2 * 1/2019 Krumanaker ..... F01D 5/187
10,174,622 B2 * 1/2019 Zhang ..... F01D 5/187
2002/0119045 A1 8/2002 Starkweather
2002/0176776 A1 * 11/2002 Parneix ..... F01D 5/187 416/97 R
2003/0026698 A1 * 2/2003 Flodman ..... F01D 5/186 416/97 R
2005/0265844 A1 * 12/2005 Levine ..... F01D 5/187 416/97 R
2006/0034890 A1 2/2006 Papple
2006/0051208 A1 * 3/2006 Lee ..... F01D 5/187 416/97 R
2006/0056967 A1 * 3/2006 Liang ..... F01D 5/186 416/97 R
2006/0222495 A1 * 10/2006 Liang ..... F01D 5/186 416/97 R
2007/0253815 A1 * 11/2007 Kopmels ..... F01D 5/186 416/97 R
2008/0050244 A1 * 2/2008 Cherolis ..... F01D 5/187 416/97 R
2014/0086756 A1 * 3/2014 Papple ..... F01D 5/081 416/90 R
2014/0093386 A1 4/2014 Pointon et al.
2016/0341046 A1 * 11/2016 Feldmann ..... F01D 5/187
2017/0009590 A1 * 1/2017 Nilsson ..... F01D 5/187
2017/0138200 A1 5/2017 Negulescu et al.

* cited by examiner

TURBINE BLADE COOLING SYSTEM WITH CHANNEL TRANSITION

CROSS-REFERENCE TO RELATED APPLICATIONS

This application claims the benefit of U.S. provisional patent application Ser. No. 62/598,363 entitled "Improved Turbine Blade Cooling System" filed on Dec. 13, 2017. The foregoing application is hereby incorporated by reference in their entirety.

TECHNICAL FIELD

The present disclosure generally pertains to gas turbine engines. More particularly this application is directed toward a turbine blade with improved cooling capabilities.

BACKGROUND

Internally cooled turbine blades may include passages and vanes (air deflectors) within the blade. These hollow blades may be cast. In casting hollow gas turbine engine blades having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs, and similar features separating and/or residing in cooling passageways in the cast airfoil.

U.S. Pat. No. 6,974,308B2 to S. Halfmann et Al. discloses a robust multiple-walled, multi-pass, high cooling effectiveness cooled turbine vane or blade designed for ease of manufacturability, minimizes cooling flows on highly loaded turbine rotors. The vane or blade design allows the turbine inlet temperature to increase over current technology levels while simultaneously reducing turbine cooling to low levels. A multi-wall cooling system is described, which meets the inherent conflict to maximize the flow area of the cooling passages while retaining the required section thickness to meet the structural requirements. Independent cooling circuits for the vane or blade's pressure and suction surfaces allow the cooling of the airfoil surfaces to be tailored to specific heat load distributions (that is, the pressure surface circuit is an independent forward flowing serpentine while the suction surface is an independent rearward flowing serpentine). The cooling air for the independent circuits is supplied through separate passages at the base of the vane or blade. The cooling air follows intricate passages to feed the serpentine thin outer wall passages, which incorporate pin fins, turbulators, etc. These passages, while satisfying the aero/thermal/stress requirements, are of a manufacturing configuration that may be cast with single crystal materials using conventional casting techniques.

The present disclosure is directed toward overcoming one or more of the problems discovered by the inventors.

SUMMARY

A turbine blade is disclosed herein. The turbine blade having a base and an airfoil. The base including a first inner channel cooling inlet, second inner channel cooling inlet, a forward face and aft face. The airfoil comprising a skin extending from the base and defining a leading edge, a trailing edge, a pressure side, and a lift side. The airfoil having a tip end distal from the base.

The turbine blade also includes an inner spar, a trailing edge rib, a pressure side inner spar rib, and a lift side inner spar rib. The inner spar is disposed between the leading edge and the trailing edge, extending from the base towards the tip end. The trailing edge rib extends from the pressure side of the skin to the lift side of the skin. The trailing edge rib also extends from the base towards the tip end. The pressure side inner spar rib is disposed between the leading edge and the trailing edge, extending from the inner spar to the pressure side. The lift side inner spar rib is disposed between the leading edge and the trailing edge, extending from the inner spar to the lift side.

The turbine blade further includes a first inner channel and a second inner channel. The first inner channel extending from the first inner channel cooling air inlet towards the tip end. The second inner channel extending from the second inner channel cooling air inlet towards the tip end and disposed between the first inner channel and aft face adjacent the second inner channel cooling inlet.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
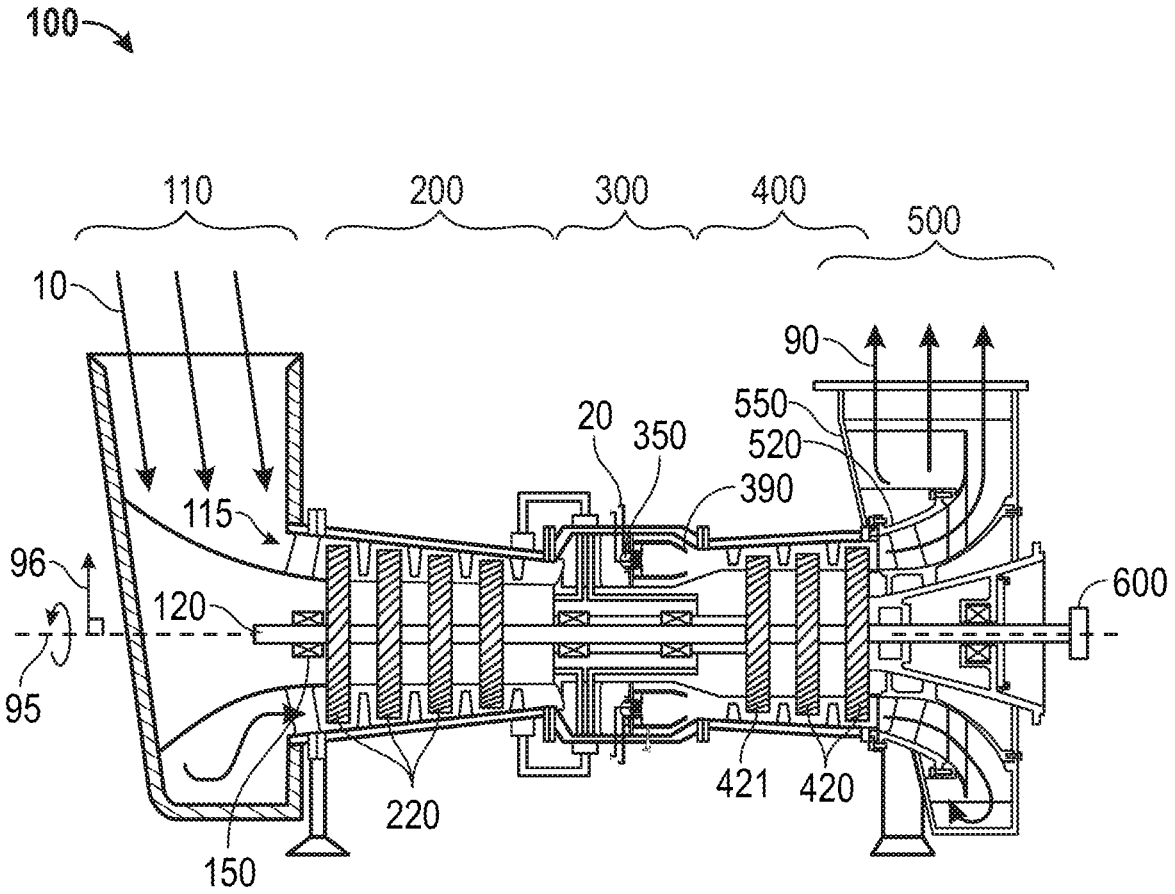
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

Structurally, a gas turbine engine 100 includes an inlet 110, a gas producer or "compressor" 200, a combustor 300, a turbine 400, an exhaust 500, and a power output coupling 600. The compressor 200 includes one or more compressor rotor assemblies 220. The combustor 300 includes one or more injectors 350 and includes one or more combustion chambers 390. The turbine 400 includes one or more turbine rotor assemblies 420. The exhaust 500 includes an exhaust diffuser 520 and an exhaust collector 550.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") 250, 450 circumferentially distributed in an annular casing.

Functionally, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
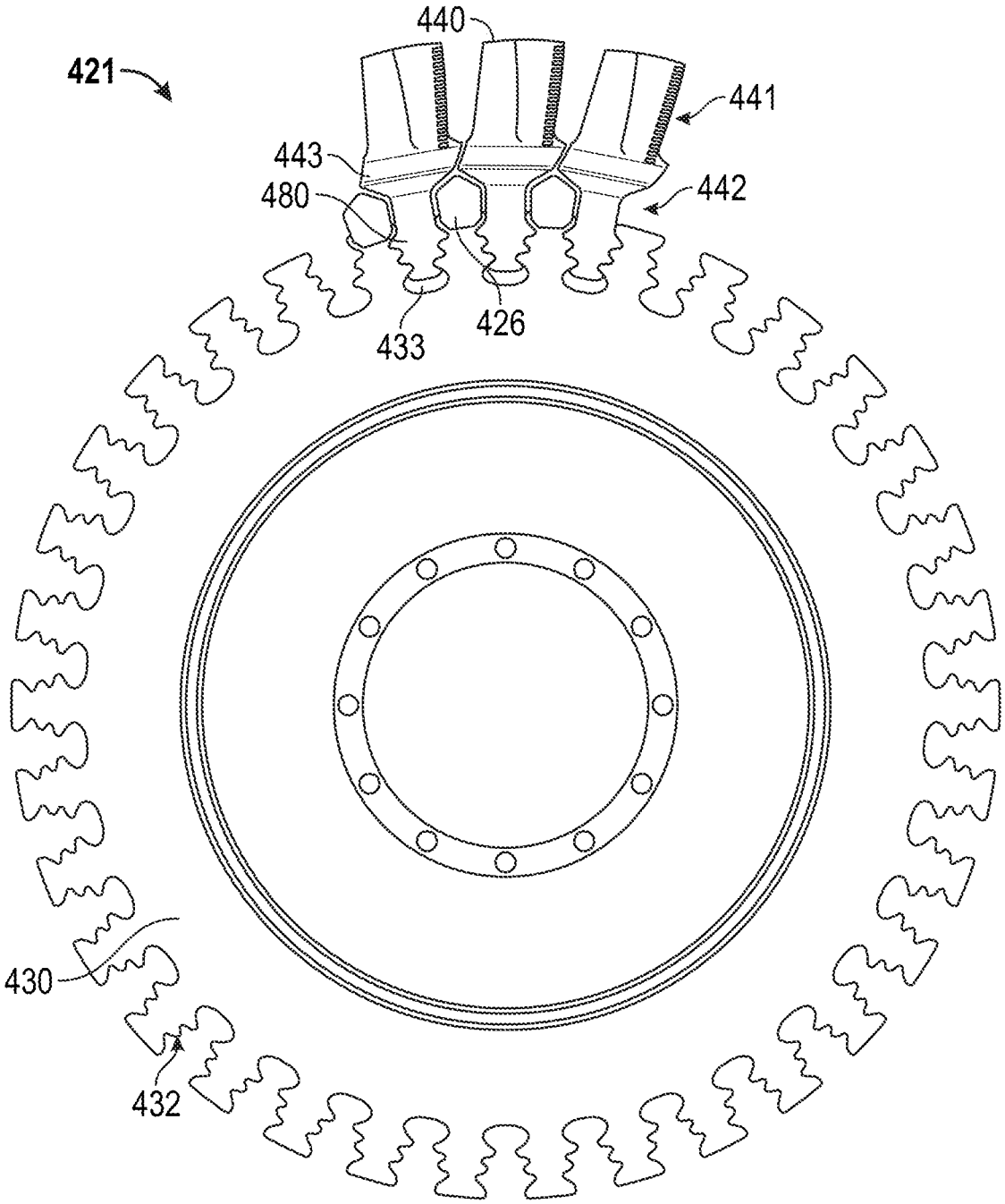
FIG. 2 is an axial view of an exemplary turbine rotor assembly.

FIG. 2 is an axial view of an exemplary turbine rotor assembly. In particular, first stage turbine rotor assembly 421 schematically illustrated in FIG. 1 is shown here in greater detail, but in isolation from the rest of gas turbine engine 100. First stage turbine rotor assembly 421 includes a turbine rotor disk 430 that is circumferentially populated with a plurality of turbine blades configured to receive cooling air ("cooled turbine blades" 440) and a plurality of dampers 426. Here, for illustration purposes, turbine rotor disk 430 is shown depopulated of all but three cooled turbine blades 440 and three dampers 426.

Each cooled turbine blade 440 may include a base 442 including a platform 443, a blade root 480, and a root end 444. For example, the blade root 480 may incorporate "fir tree", "bulb", or "dove tail" roots, to list a few. Correspondingly, the turbine rotor disk 430 may include a plurality of circumferentially distributed slots or "blade attachment grooves" 432 configured to receive and retain each cooled turbine blade 440. In particular, the blade attachment grooves 432 may be configured to mate with the blade root 480, both having a reciprocal shape with each other. In addition the blade attachment grooves 432 may be slideably engaged with the blade attachment grooves 432, for example, in a forward-to-aft direction.

Being proximate the combustor 300 (FIG. 1), the first stage turbine rotor assembly 421 may incorporate active cooling. In particular, compressed cooling air may be internally supplied to each cooled turbine blade 440 as well as predetermined portions of the turbine rotor disk 430. For example, here turbine rotor disk 430 engages the cooled turbine blade 440 such that a cooling air cavity 433 is formed between the blade attachment grooves 432 and the blade root 480. In other embodiments, other stages of the turbine may incorporate active cooling as well.

When a pair of cooled turbine blades 440 is mounted in adjacent blade attachment grooves 432 of turbine rotor disk 430, an under-platform cavity may be formed above the circumferential outer edge of turbine rotor disk 430, between shanks of adjacent blade roots 480, and below their adjacent platforms 443, respectively. As such, each damper 426 may be configured to fit this under-platform cavity. Alternately, where the platforms are flush with circumferential outer edge of turbine rotor disk 430, and/or the under-platform cavity is sufficiently small, the damper 426 may be omitted entirely.

Here, as illustrated, each damper 426 may be configured to constrain received cooling air such that a positive pressure may be created within under-platform cavity to suppress the ingress of hot gases from the turbine. Additionally, damper 426 may be further configured to regulate the flow of cooling air to components downstream of the first stage turbine rotor assembly 421. For example, damper 426 may include one or more aft plate apertures in its aft face. Certain features of the illustration may be simplified and/or differ from a production part for clarity.

Each damper 426 may be configured to be assembled with the turbine rotor disk 430 during assembly of first stage turbine rotor assembly 421, for example, by a press fit. In addition, the damper 426 may form at least a partial seal with the adjacent cooled turbine blades 440. Furthermore, one or more axial faces of damper 426 may be sized to provide sufficient clearance to permit each cooled turbine blade 440 to slide into the blade attachment grooves 432, past the damper 426 without interference after installation of the damper 426.

Figure 3:
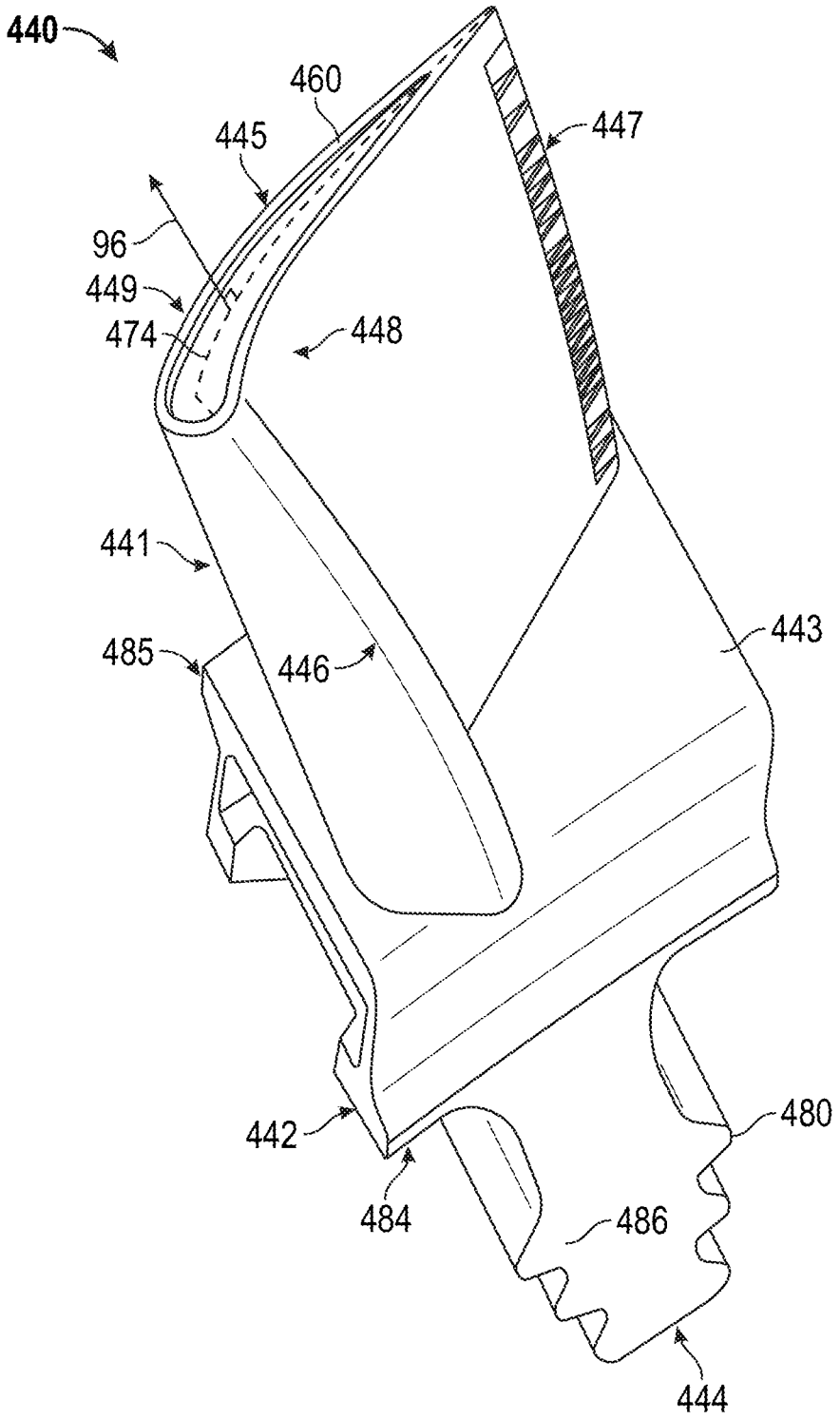
FIG. 3 is an isometric view of one turbine blade of FIG. 2.

FIG. 3 is a perspective view of the turbine blade of FIG. 2. As described above, the cooled turbine blade 440 may include a base 442 having a platform 443, a blade root 480, and a root end 444. Each cooled turbine blade 440 may further include an airfoil 441 extending radially outward from the platform 443. The airfoil 441 may have a complex, geometry that varies radially. For example the cross section of the airfoil 441 may lengthen, thicken, twist, and/or change shape as it radially approaches the platform 443 inward from a tip end 445. The overall shape of airfoil 441 may also vary from application to application.

The cooled turbine blade 440 is generally described herein with reference to its installation and operation. In particular, the cooled turbine blade 440 is described with reference to both a radial 96 of center axis 95 (FIG. 1) and the aerodynamic features of the airfoil 441. The aerodynamic features of the airfoil 441 include a leading edge 446, a trailing edge 447, a pressure side 448, a lift side 449, and its mean camber line 474. The mean camber line 474 is generally defined as the line running along the center of the airfoil from the leading edge 446 to the trailing edge 447. It can be thought of as the average of the pressure side 448 and lift side 449 of the airfoil 441 shape. As discussed above, airfoil 441 also extends radially between the platform 443 and the tip end 445. Accordingly, the mean camber line 474 herein includes the entire camber sheet continuing from the platform 443 to the tip end 445.

Figure 9:
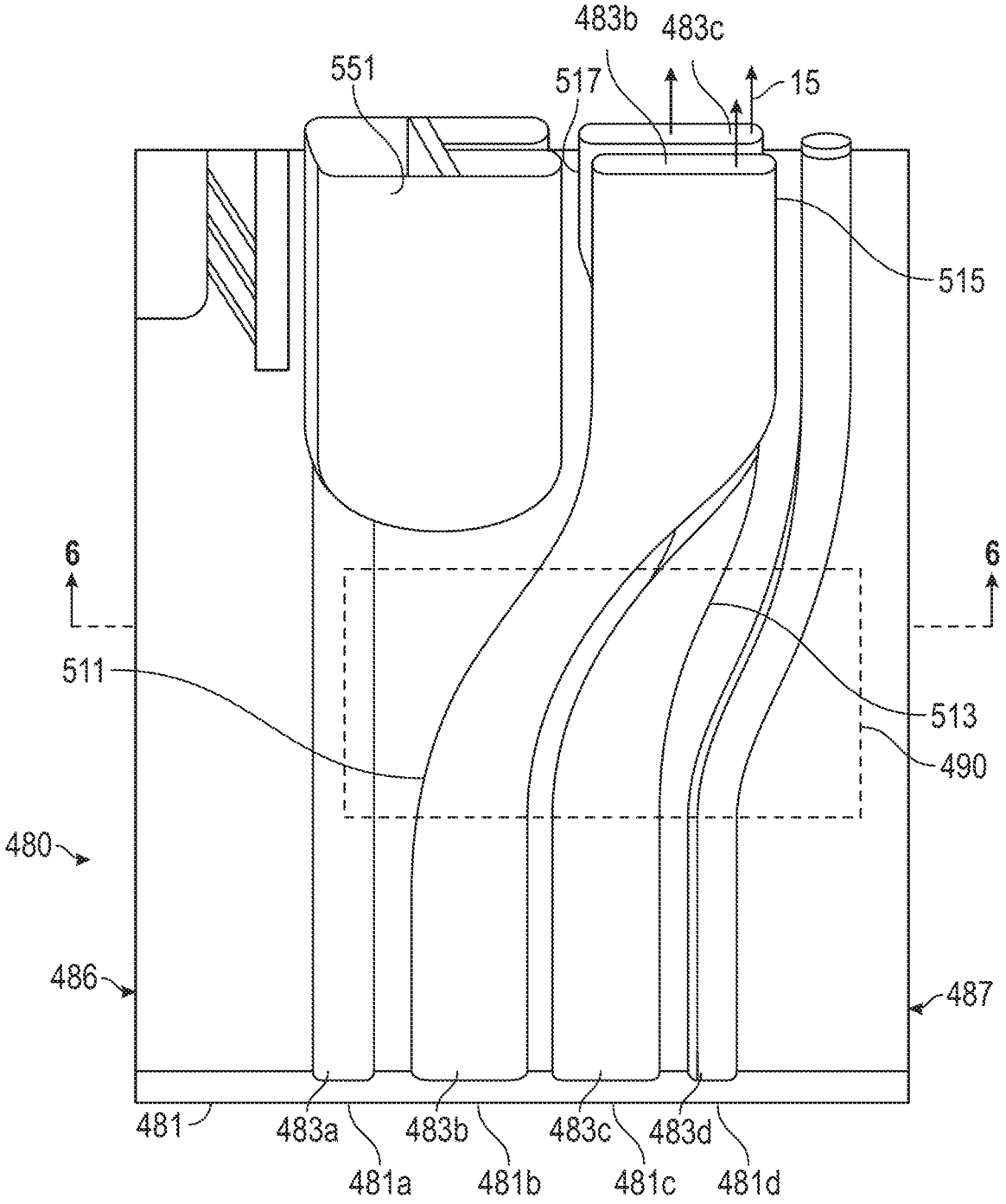
FIG. 9 is a cutaway perspective view of a portion of the turbine blade of FIG. 3.

Thus, when describing the cooled turbine blade 440 as a unit, the inward direction is generally radially inward toward the center axis 95 (FIG. 1), with its associated end called a "root end" 444. Likewise the outward direction is generally radially outward from the center axis 95 (FIG. 1), with its associated end called the "tip end" 445. When describing the platform 443, the forward edge 484 and the aft edge 485 of the platform 443 is associated to the forward and aft axial directions of the center axis 95 (FIG. 1), as described above. The base 442 can further include a forward face 486 and an aft face 487 (FIG. 9). The forward face 486 corresponds to the face of the base 442 that is disposed on the forward end of the base 442. The aft face 487 corresponds to the face of the base 442 that is disposed distal from the forward face 486.

In addition, when describing the airfoil 441, the forward and aft directions are generally measured between its leading edge 446 (forward) and its trailing edge 447 (aft), along the mean camber line 474 (artificially treating the mean camber line 474 as linear). When describing the flow features of the airfoil 441, the inward and outward directions are generally measured in the radial direction relative to the center axis 95 (FIG. 1). However, when describing the thermodynamic features of the airfoil 441 (particularly those associated with the inner spar 462 (FIG. 4)), the inward and outward directions are generally measured in a plane perpendicular to a radial 96 of center axis 95 (FIG. 1) with inward being toward the mean camber line 474 and outward being toward the "skin" 460 of the airfoil 441.

Finally, certain traditional aerodynamics terms may be used from time to time herein for clarity, but without being limiting. For example, while it will be discussed that the airfoil 441 (along with the entire cooled turbine blade 440) may be made as a single metal casting, the outer surface of the airfoil 441 (along with its thickness) is descriptively called herein the "skin" 460 of the airfoil 441. In another example, each of the ribs described herein can act as a wall or a divider.

Figure 4:
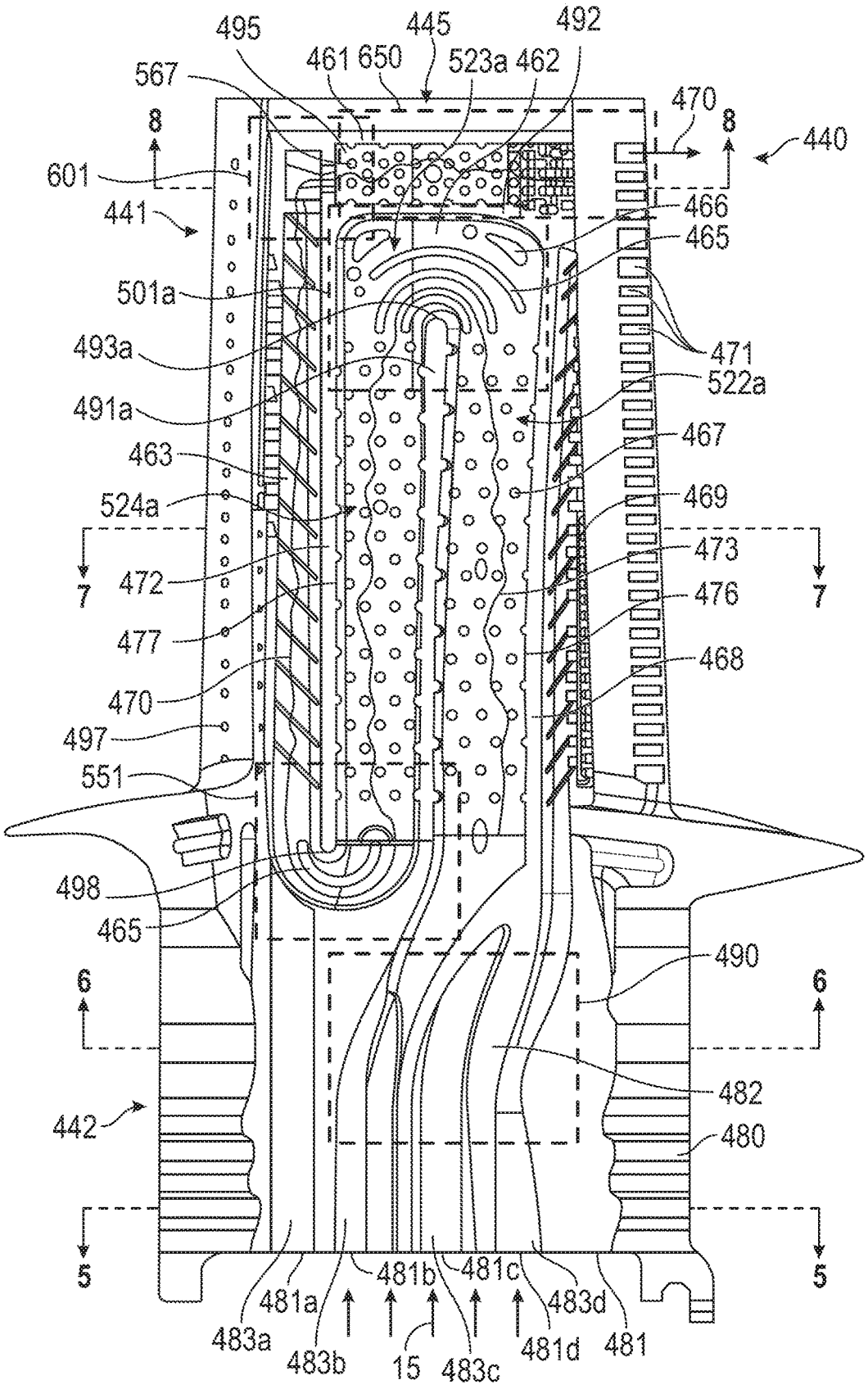
FIG. 4 is a cutaway side view of the turbine blade of FIG. 3.

FIG. 4 is a cutaway side view of the turbine blade of FIG. 3. In particular, the cooled turbine blade 440 of FIG. 3 is shown here with the skin 460 removed from the pressure side 448 of the airfoil 441, exposing its internal structure and cooling paths. The airfoil 441 may include a composite flow path made up of multiple subdivisions and cooling structures. Similarly, a section of the base 442 has been removed to expose portions of a cooling air passageway 482, internal to the base 442. The cooling air passageway 482 can have one or more channels 483 extending from the blade root 480 toward the tip end 445 as described below. The turbine blade 440 shown in FIG. 4 generally depicts the features visible from the pressure side 448. However, in some embodiments, similar features may exist on the lift side 449 with similar arrangement to the features shown on the pressure side 448 shown in FIG. 4.

The cooled turbine blade 440 may include an airfoil 441 and a base 442. The base 442 may include the platform 443, the blade root 480, and one or more cooling air inlet(s) 481. The airfoil 441 interfaces with the base 442 and may include the skin 460, a tip wall 461, and the cooling air outlet 471.

Compressed secondary air may be routed into one or more cooling air inlet(s) 481 in the base 442 of cooled turbine blade 440 as cooling air 15. The one or more cooling air inlet(s) 481 may be at any convenient location. For example, here, the cooling air inlet 481 is located in the blade root 480. Alternately, cooling air 15 may be received in a shank area radially outward from the blade root 480 but radially inward from the platform 443.

Figure 13:
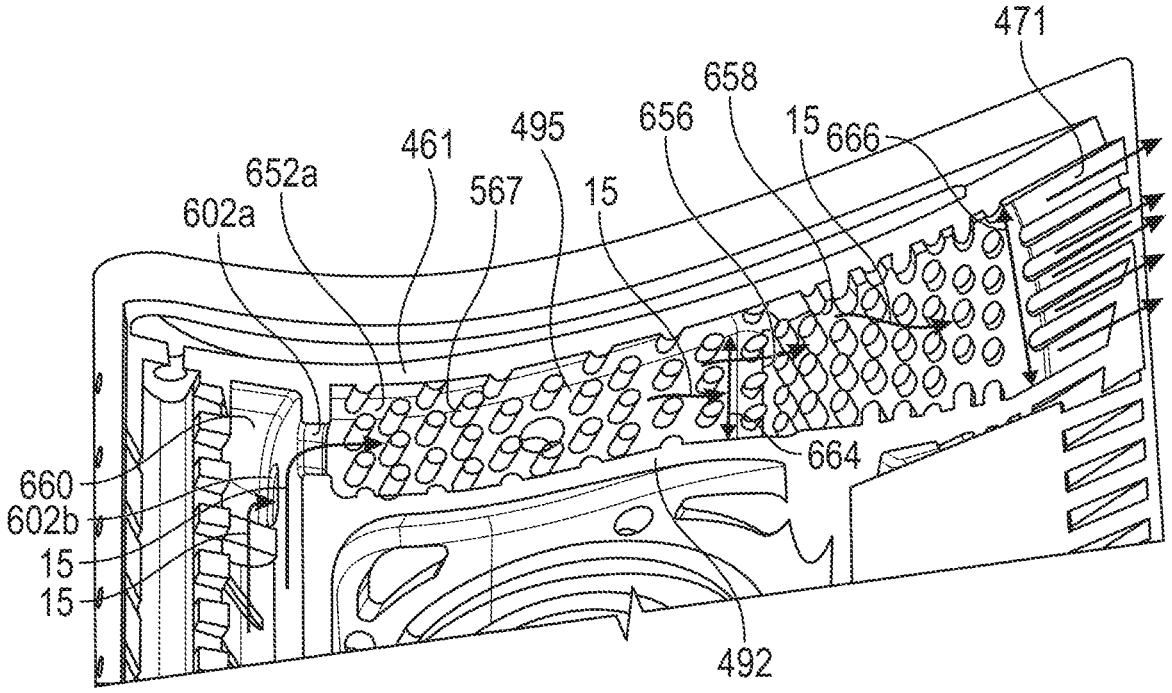
FIG. 13 is a cutaway perspective view of a portion of the turbine blade of FIG. 3.
Figure 14:
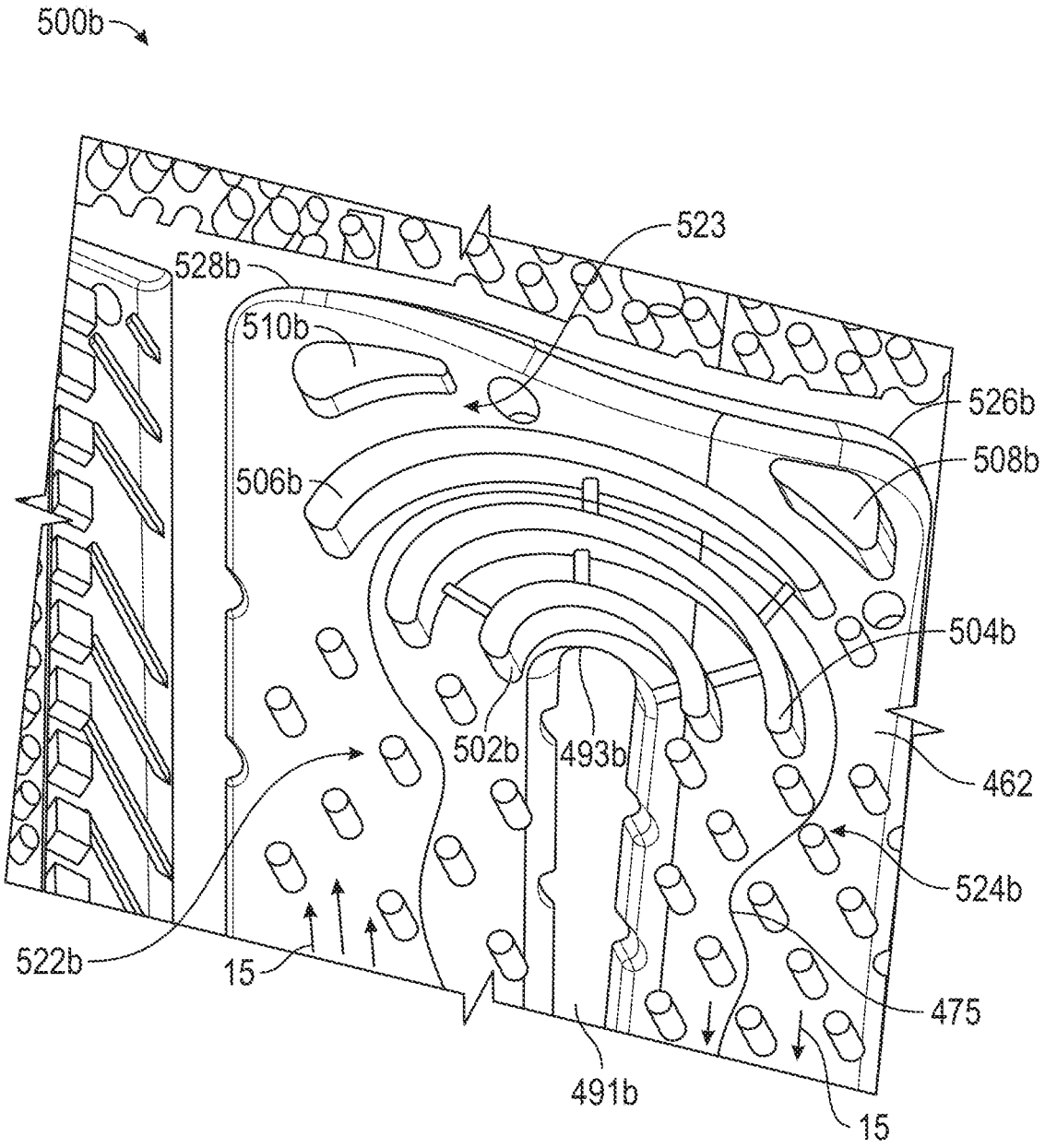
FIG. 14 is a cutaway perspective view of a portion of the turbine blade of FIG. 3.

Within the base 442, the cooled turbine blade 440 includes the cooling air passageway 482 that is configured to route cooling air 15 from the one or more cooling air inlet(s) 481, through the base, and into the airfoil 441 via the channels 483. The cooling air passageway 482 may be configured to translate the cooling air 15 in three dimensions (e.g., not merely in the plane of the figure) as it travels radially up (e.g., generally along a radial 96 of the center axis 95 (FIG. 1)) towards the airfoil 441 and along the multi-bend heat exchange path 470. For example, the cooling air 15 can travel radially and within the airfoil 441. Further, the inner spar 462 effectively splits the cooling air 15 between pressure side 448 and the lift side 449. The multi-bend heat exchange path 470 is depicted as a solid line drawn as a weaving path through the airfoil 441, exiting through the tip flag cooling system 650 (FIG. 13) ending with an arrow. The multi-bend heat exchange path 470 can include a pressure side portion of the multi-bend heat exchange path 473 (shown) and a lift side portion of the multi-bend heat exchange path 475 (FIG. 14). Moreover, the cooling air passageway 482 may be structured to receive the cooling air 15 from a generally rectilinear cooling air inlet 481 and smoothly "reshape" it to fit the curvature and shape of the airfoil 441. In addition, the cooling air passageway 482 may be subdivided into a plurality of subpassages or channels 483 that direct the cooling air in one or more paths through the airfoil 441.

Within the skin 460 of the airfoil 441, several internal structures are viewable. In particular, airfoil 441 may include the tip wall 461, an inner spar 462, a leading edge chamber 463, one or more turning vane(s) 465, one or more air deflector(s) 466, and a plurality of cooling fins. In addition, airfoil 441 may include a trailing edge rib 468, leading edge rib 472, inner spar cap 492, and pressure side inner spar rib 491*a*. The trailing edge rib 468 may be perforated and may allow flow of the cooling air 15 to exit the trailing edge 447. The pressure side inner spar rib 491*a* may separate the cooling air 15 between the trailing edge rib 468 and leading edge rib 472 on the pressure side of the inner spar 462. The leading edge rib 472 is configured to separate flow of the cooling air 15 from between the leading edge rib 472 and pressure inner spar rib 491*a* and from the leading edge chamber 463. Together with the skin 460, these structures may form the multi-bend heat exchange path 470 within the airfoil 441.

The internal structures making up the multi-bend heat exchange path 470 may form multiple discrete sub-passageways or "sections". For example, although multi-bend heat exchange path 470 is shown by a representative path of cooling air 15, multiple paths are possible as described more detail in the following sections With regard to the airfoil structures, the tip wall 461 extends across the airfoil 441 and may be configured to redirect cooling air 15 from escaping through the tip end 445. In an embodiment, the tip end 445 may be formed as a shared structure, such as a joining of the pressure side 448 and the lift side 449 of the airfoil 441. The tip wall 461 may be recessed inward such that it is not flush with the tip of the airfoil 441. The tip wall 461 may include one or more perforations (not shown) such that a small quantity of the cooling air 15 may be bled off for film cooling of the tip end 445.

The inner spar 462 may extend from the base 442 radially outward toward the tip wall 461, between the pressure side 448 (FIG. 3) and the lift side 449 (FIG. 3) of the skin 460. The inner spar 462 may also be described as extending from the root end 444 of the base 442. In addition, the inner spar 462 may extend between the leading edge 446 and the trailing edge 447, parallel with, and generally following, the mean camber line 474 (FIG. 3) of the airfoil 441. Accordingly, the inner spar 462 may be configured to bifurcate a portion or all of the airfoil 441 generally along its mean camber line 474 (FIG. 3) and between the pressure side 448 and the lift side 449. Also, the inner spar 462 may be solid (non-perforated) or substantially solid (including some perforations), such that cooling air 15 cannot pass.

According to an embodiment, the inner spar 462 may extend less than the entire length of the mean camber line 474. In particular the inner spar 462 may extend less than ninety percent of the mean camber line 474 and may exclude the leading edge chamber 463 entirely. For example, the inner spar 462 may extend from an edge of the leading edge chamber 463 proximate the trailing edge 447, downstream to the plurality of trailing edge cooling fins 469. The inner spar 462 within the skin 460 may extend from the leading edge rib 472 to the trailing edge rib 468. The inner spar 462 may extend from the base 442 towards the tip end 445. The inner spar 462 may have an inner spar leading edge 476 disposed proximal and spaced apart from the leading edge 446, and an inner spar trailing edge 477 distal from the inner spar leading edge 476. In addition, the inner spar 462 may have a length within the range of seventy to eighty percent, or approximately three quarters the length of, and along, the mean camber line 474. In some embodiments, the inner spar 462 may have a length within the range of fifty to seventy percent, or approximately three fifths the length of, and along, the mean camber line 474. The inner spar 462 may be described as extending along the majority of the mean camber line 474.

According to an embodiment, the airfoil 441 may include a trailing edge rib 468. The trailing edge rib 468 may extend radially outward from the base 442 toward the tip end 445. In addition, the trailing edge rib 468 may extend from the pressure side 448 (FIG. 3) of the skin 460 to the lift side 449 (FIG. 3) of the skin 460. The trailing edge rib 468 may be disposed proximal and spaced apart from the trailing edge 447 and within the skin 460. The trailing edge rib 468 may be perforated to include one or more openings. This can allow cooling air 15 to pass through the trailing edge rib 468 toward the cooling air outlet 471 in the trailing edge 447, and thus complete the single-bend heat exchange path 470.

According to an embodiment, the airfoil 441 may include a leading edge rib 472. The leading edge rib 472 may extend radially outward from an area proximate the base 442 toward the tip end 445, terminating prior to reaching the tip wall 461. In addition, the leading edge rib 472 may extend from the pressure side 448 (FIG. 3) of the skin 460 to the lift side 449 (FIG. 3) of the skin 460. The leading edge rib 472 may also be described as extending from the base 442 to towards the tip end 445, proximal and spaced apart from the leading edge 446 and within the skin 460 In doing so, the leading edge rib 472 may define the leading edge chamber 463 in conjunction with the skin 460 at the leading edge 446 of the airfoil 441. Additionally, at least a portion of the cooling air 15 leaving the leading edge chamber 463 may be redirected toward the trailing edge 447 by the tip wall 461 and other cooling air 15 within the airfoil 441. Accordingly, the leading edge chamber 463 may form part of the multi-bend heat exchange path 470.

According to an embodiment, the inner spar cap 492 extends across the airfoil 441 and may be configured to redirect cooling air 15 towards the leading edge chamber 463. In an embodiment, the inner spar cap 492 extends from the leading edge rib 472 to the trailing edge rib 468. The inner spar cap 492 may extend from adjacent the leading edge chamber 463 to proximate or adjacent the trailing edge 447. The inner spar cap 492 may extend from pressure side 448 to the lift side 449. The inner spar cap 492 can be adjoined to the inner spar 462 distal from the blade root 480. The inner spar cap 492 may include one or more perforations (not shown) allowing a small quantity of the cooling air 15 to pass through.

According to an embodiment, the airfoil 441 may include a pressure side inner spar rib 491*a*. The pressure side inner spar rib 491*a* may extend radially from the base 442 toward the tip end 445, terminating prior to reaching the end of the inner spar 462 distal from the blade root 480. The pressure side inner spar rib 491*a* may have a pressure side inner spar rib outward end 493*a* that is distal from the blade root 480. Similarly, the lift side 449 of the inner spar 462 may also have a similar rib.

The pressure side inner spar rib 491*a* may extend from the pressure side 448 of the inner spar 462 toward the pressure side 448 of the skin 460. In doing so, the pressure inner spar rib 491*a* may define a pressure side trailing edge section 522*a* in conjunction with the trailing edge rib 468, the inner spar 462, and the skin 460 at the pressure side 448 of the airfoil 441. The pressure side trailing edge section 522*a* may be a portion of a first inner channel 483*b*. In other words, the pressure side trailing edge section 522*a* may be defined by the pressure side inner spar rib 491*a*, the trailing edge rib 468, the inner spar 462, the inner spar cap 492, and the skin 460 at the pressure side 448 of the airfoil 441. At least a portion of the cooling air 15 leaving the pressure side trailing edge section 522*a* may be redirected toward a pressure side transition section 523*a*. Accordingly, the pressure side trailing edge section 522*a* may form part of the multi-bend heat exchange path. Similarly, the lift side 449 of the inner spar 462 may also have a similar defined space as a portion of a second inner channel 483*c*.

The pressure side transition section 523*a* may be a portion of the first inner channel 483*b* and can be defined by the space confined by the inner spar cap 492, the trailing edge rib 468, the leading edge rib 472, and a plane extending from the pressure side inner spar rib outward end 493*a*, perpendicular to the pressure side inner spare rib 491*a* and extending to the trailing edge rib 468, leading edge rib 472, inner spar 462, and skin 460. The pressure side transition section 523*a* can adjoin and be in flow communication with the pressure side trailing edge section 522*a*. At least a portion of the cooling air 15 leaving the pressure side transition section 523*a* may be redirected toward the pressure side leading edge section 524*a*. Accordingly, the pressure side transition section 523*a* may form part of the multi-bend heat exchange path 470. Similarly, the lift side 449 of the inner spar 462 may also have a similar defined space as a portion of the second inner channel 483*c*.

The pressure side inner spar rib 491*a*, the leading edge rib 472, the inner spar 462, the inner spar cap 492, and the skin 460 at the pressure side 448 of the airfoil 441, may define a pressure side leading edge section 524*a*. The pressure side leading edge section 524*a* may be a portion of the first inner channel 483*b*. In other words, the pressure side leading edge section 524*a* may be located between the pressure side inner spar rib 491*a*, the leading edge rib 472, the inner spar 462, and the skin 460 at the pressure side 448 of the airfoil 441. The pressure side leading edge section 524*a* can adjoin and be in flow communication with the pressure side transition section 523*a*. At least a portion of the cooling air 15 leaving the pressure side leading edge section 524*a* may be redirected toward the leading edge chamber 463. Accordingly, the pressure side leading edge section 524*a* may form part of the multi-bend heat exchange path 470. Similarly, the lift side 449 of the inner spar 462 may also have a similar defined space as a portion of the second inner channel 483*c*.

Within the airfoil 441, a plurality of inner spar cooling fins 467 may extend outward from the inner spar 462 to the skin 460 on either of the pressure side 448 (FIG. 3) or the lift side 449 (FIG. 3). In addition, a plurality of flag cooling fins 567 may extend outward from the flag spar 495 to the skin 460 on either of the pressure side 448 or the lift side 449. In contrast, the plurality of trailing edge cooling fins 469 may extend from the pressure side 448 (FIG. 3) of the skin 460 directly to the lift side 449 (FIG. 3) of the skin 460. Accordingly, the plurality of inner spar cooling fins 467 are located forward of the plurality of trailing edge cooling fins 469, as measured along the mean camber line 474 (FIG. 3) of the airfoil 441. Furthermore, the plurality of the inner spar cooling fins 467 may be radially inward of the plurality of flag cooling fins 567.

Both the inner spar cooling fins 467, flag cooling fins 567, and the trailing edge cooling fins 469 may be disbursed copiously throughout the single-bend heat exchange path 470. In particular, the inner spar cooling fins 467, flag cooling fins 567, and the trailing edge cooling fins 469 may be disbursed throughout the airfoil 441 so as to thermally interact with the cooling air 15 for increased cooling. In addition, the distribution may be in the radial direction and in the direction along the mean camber line 474 (FIG. 3). The distribution may be regular, irregular, staggered, and/or localized.

According to an embodiment, the inner spar cooling fins 467 may be long and thin. In particular, inner spar cooling fins 467, traversing less than half the thickness of the airfoil 441, may use a round "pin" fin. Moreover, pin fins having a height-to-diameter ratio of 2-7 may be used. For example, the inner spar cooling fins 467 may be pin fins having a diameter of 0.017-0.040 inches, and a length off the inner spar 462 of 0.034-0.280 inches.

Additionally, according to one embodiment, the inner spar cooling fins 467 may also be densely packed. In particular, inner spar cooling fins 467 may be within two diameters of each other. Thus, a greater number of inner spar cooling fins 467 may be used for increased cooling. For example, across the inner spar 462, the fin density may be in the range of 80 to 300 fins per square inch per side of the inner spar 462. The fin density may also be in the range of 40 to 200 fins per square inch per side of the inner spar 462.

According to an embodiment, the flag cooling fins 567 may be long and thin. In particular, flag cooling fins 567, traversing less than half the thickness of the airfoil 441, may use a round "pin" fin. Moreover, pin fins having a height-to-diameter ratio of 2-7 may be used. For example, the flag cooling fins 567 may be pin fins having a diameter of 0.017-0.040 inches, and a length off the flag spar 495 of 0.034-0.280 inches.

Additionally, according to one embodiment, the flag cooling fins 567 may also be densely packed. In particular, flag cooling fins 567 may be within two diameters of each other. Thus, a greater number of flag cooling fins 567 may be used for increased cooling. For example, across the flag spar 495, the fin density may be in the range of 80 to 300 fins per square inch per side of the flag spar 495. The fin density may also be in the range of 40 to 200 fins per square inch per side of the flag spar 495.

Taken as a whole the cooling air passageway 482 and the multi-bend heat exchange path 470 may be coordinated. In particular and returning to the base 442 of the cooled turbine blade 440, the cooling air passageway 482 may be subdivided into a plurality of flow paths. These flow paths may be arranged in a serial arrangement as the air 15 enters the blade root 480 at the cooling air inlet 481, as shown in FIG. 4. The cooling air inlets 481 may include a first outer channel cooling air inlet 481*a*, a first inner channel cooling air inlet 481*b*, a second inner channel cooling air inlet 481*c*, and a second outer channel cooling air inlet 481*d*. The cooling air inlets 481 can funnel the cooling air 15 into multiple sub passageways or channels 483, labeled individually as first outer channel 483*a*, first inner channel 483*b*, second inner channel 483*c*, and second outer channel 483*d* chord-wise along the blade root 480. The serial arrangement may be advantageous given the limited amount of available surface area on the blade root 480. Other (e.g., parallel) arrangements may limit the flow of cooling air 15 into the cooling air inlets 481.

The first outer channel 483*a* can be in flow communication with the leading edge chamber 463. The first inner channel 483*b* and second inner channel 483*c* may define different flow paths and be in flow communication with the leading edge chamber 463.

The flow path of the cooling air passageway 482 may change from the serial arrangement to a parallel or a series-parallel arrangement as the cooling air 15 continues through the channels 483 and the multi-bend heat exchange path 470. These arrangements are described in further detail in connection with FIG. 5 through FIG. 9. Each subdivision within the base 442 may be aligned with and include a cross sectional shape (see, FIG. 5) corresponding to the areas bounded by the skin 460. In addition, the cooling air passageway 482 may maintain the same overall cross sectional area (i.e., constant flow rate and pressure) in each subdivision (e.g., the channels 483), as between the cooling air inlet 481 and the airfoil 441. Alternately, the cooling air passageway 482 may vary the cross sectional area of the individual channels 483 where differing performance parameters are desired for each section, in a particular application.

According to one embodiment, the cooling air passageway 482 and the multi-bend heat exchange path 470 may each include asymmetric divisions for reflecting localized thermodynamic flow performance requirements. In particular, as illustrated, the cooled turbine blade 440 may have two or more sections divided by the one or more serial or parallel channels 483.

According to an embodiment, the individual inner spar cooling fins 467, flag cooling fins 567, and the trailing edge cooling fins 469 may also include localized thermodynamic structural variations. In particular, the inner spar cooling fins 467, flag cooling fins 567, and/or the trailing edge cooling fins 469 may have different cross sections/surface area and/or fin spacing at different locations of the inner spar 462, the flag spar 495, and proximate the trailing edge 447. For example, the cooled turbine blade 440 may have localized "hot spots" that favor a greater thermal conductivity, or low internal flow areas that favor reduced airflow resistance. In which case, the individual cooling fins may be modified in shape, size, positioning, spacing, and grouping.

According to one embodiment, one or more of the inner spar cooling fins 467, flag cooling fins 567, and the trailing edge cooling fins 469 may be pin fins or pedestals. The pin fins or pedestals may include many different cross-sectional areas, such as: circular, oval, racetrack, square, rectangular, diamond cross-sections, just to mention only a few. As discussed above, the pin fins or pedestals may be arranged as a staggered array, a linear array, or an irregular array.

In some embodiments, the cooling air 15 can flow into the blade root 480 via the cooling air inlet 481 into the cooling air passageway 482 (e.g., the channels 483). The cooling air passageway 482 can be arranged in multiple sections with different geometries arranged chord-wise along the cooled turbine blade 440. The varying geometries are shown in FIG. 5, FIG. 6, FIG. 7, and FIG. 8.

Figure 10:
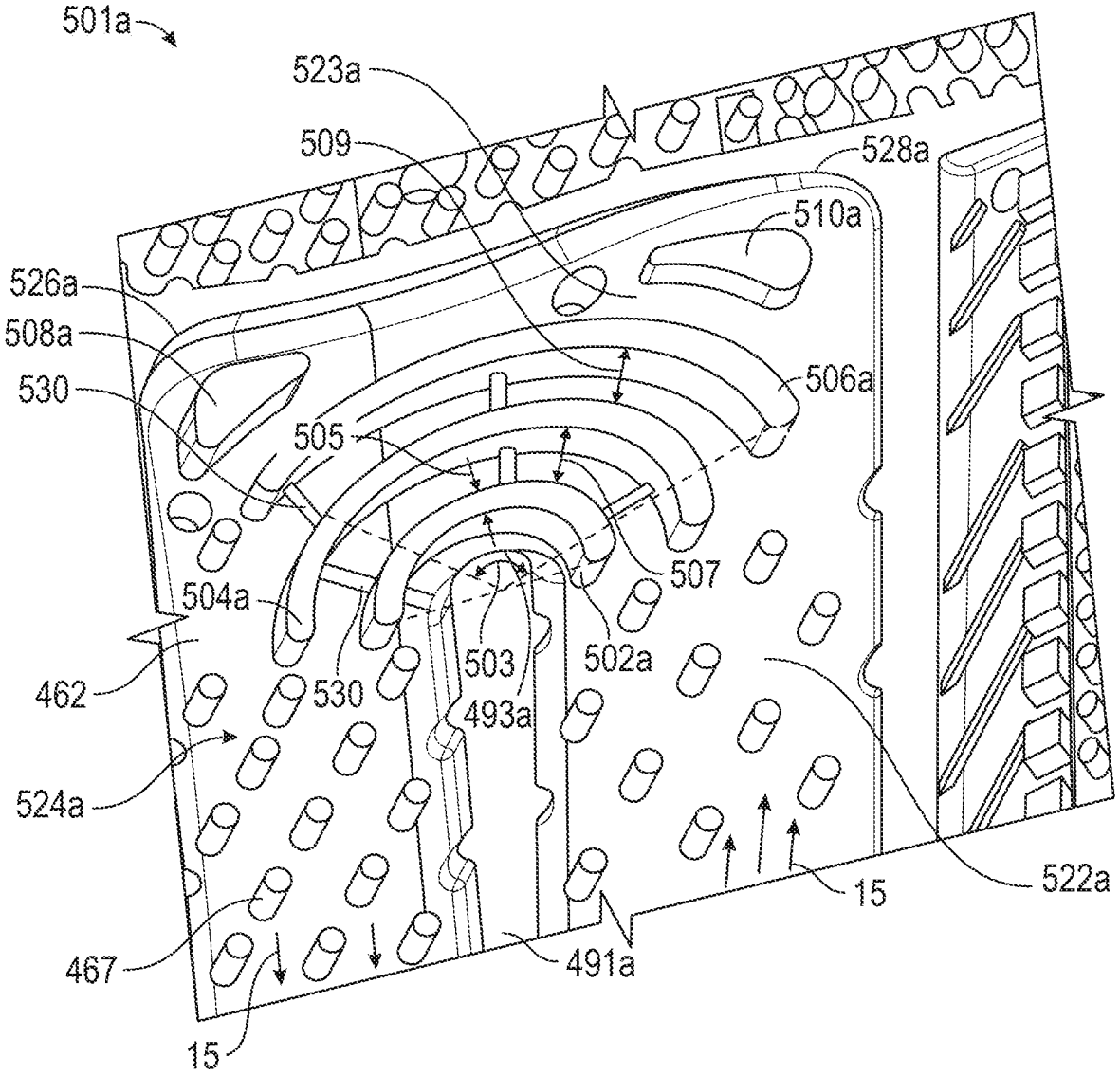
FIG. 10 is a cutaway perspective view of a portion of the turbine blade of FIG. 3.
Figure 11:
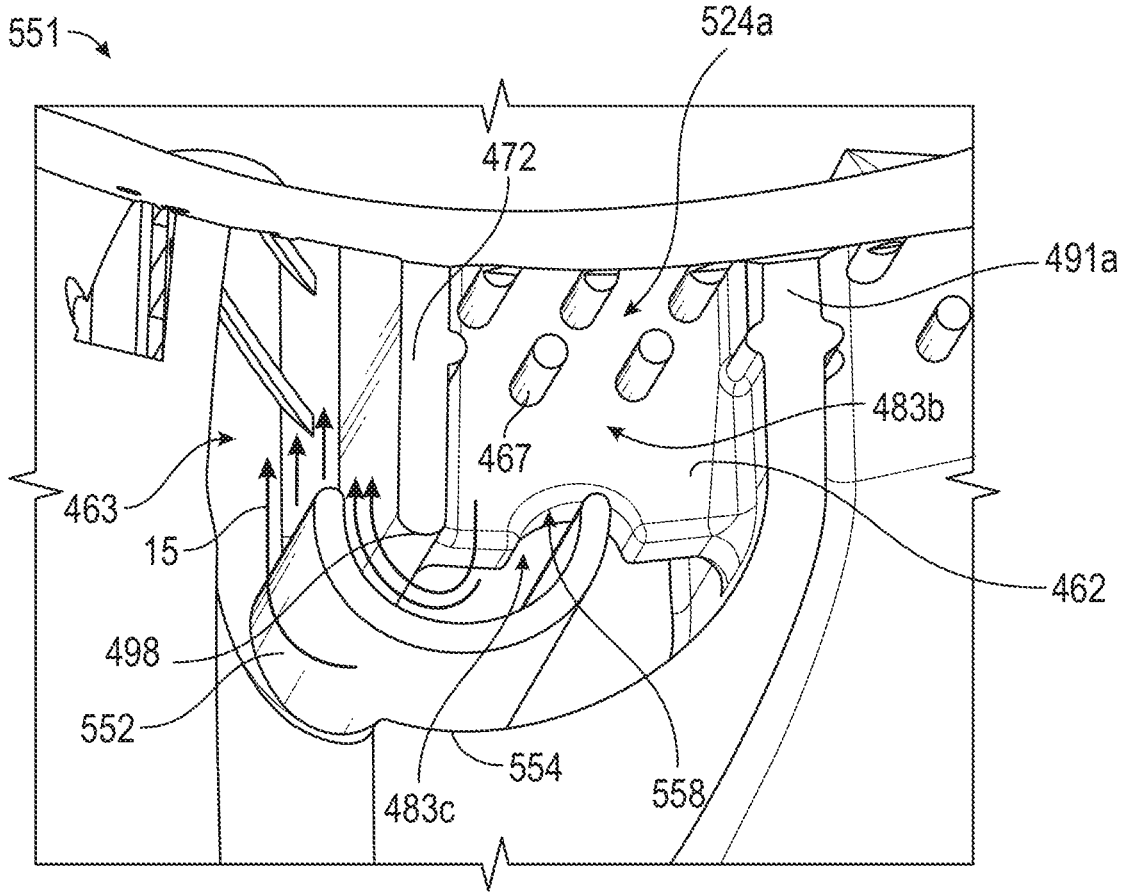
FIG. 11 is a cutaway perspective view of a portion of the turbine blade of FIG. 3.
Figure 12:
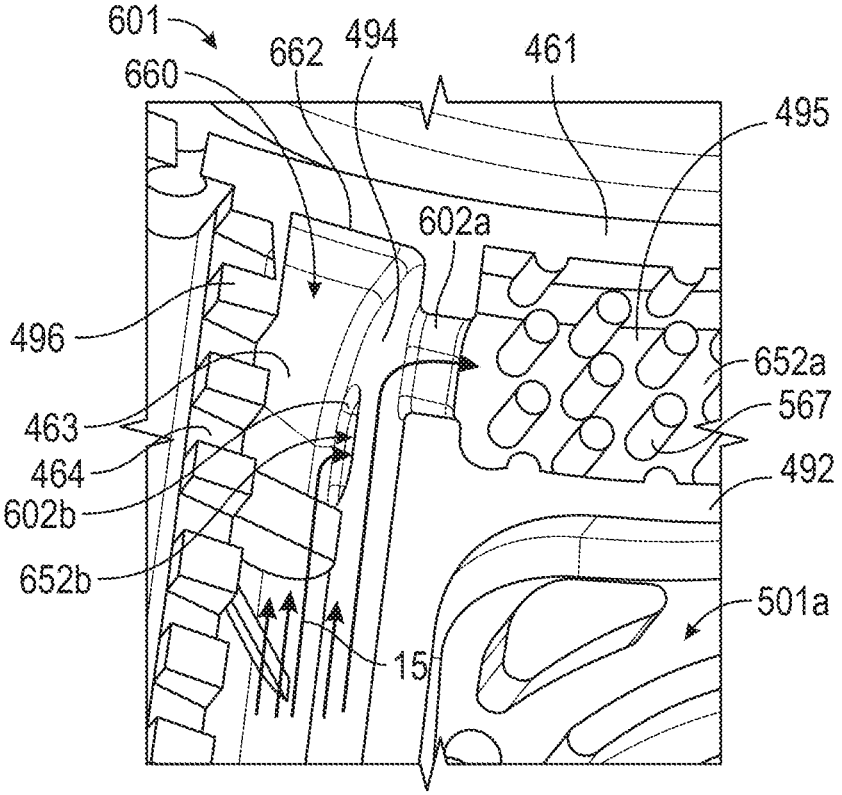
FIG. 12 is a cutaway perspective view of a portion of the turbine blade of FIG. 3.

The multi-bend heat exchange path 470 can proceed as follows. The cooling air 15 can enter the blade root 480 at the cooling air inlet 481, flowing through the channels 483. The channels 483 can begin in a series arrangement (FIG. 5) at the blade root 480. In some embodiments, at least the first inner channel 483*b* and second inner channel 483*c* can enter a series-to-parallel transition 490 (indicated in dashed lines) that twists and redirects the channels 483*b*, 483*c* from the series arrangement at the first inner channel cooling air inlet 481*b* and the second inner channel cooling air inlet 481*c* to a parallel arrangement. The first inner channel 483*b* and second inner channel 483*c* can be routed radially outward toward the tip end 445 and a pressure side upper turning vane bank 501*a* shown in dashed lines (FIG. 10). The pressure side upper turning vane bank 501*a* can redirect the cooling air 15 back toward the base 442 and a lower turning vane bank 551 shown in dashed lines (FIG. 11). The lower turning vane bank 551 can redirect the cooling air 15 toward the tip end 445 and transition the parallel flow of the first inner channel 483*b* and second inner channel 483*c* into a single, serial channel of the leading edge chamber 463. The leading edge chamber 463 can direct at least a portion of the cooling air 15 back toward the tip end 445 and a tip diffuser 601 shown in dashed lines (FIG. 12). The tip diffuser 601 can diffuse the cooling air 15 from the single (e.g., series) leading edge chamber 463 into parallel diffuser outputs 602 in flow communication with parallel tip flag channels 652 (FIG. 8) within a tip flag cooling system 650 shown in dashed lines (FIG. 13).

Figure 5:
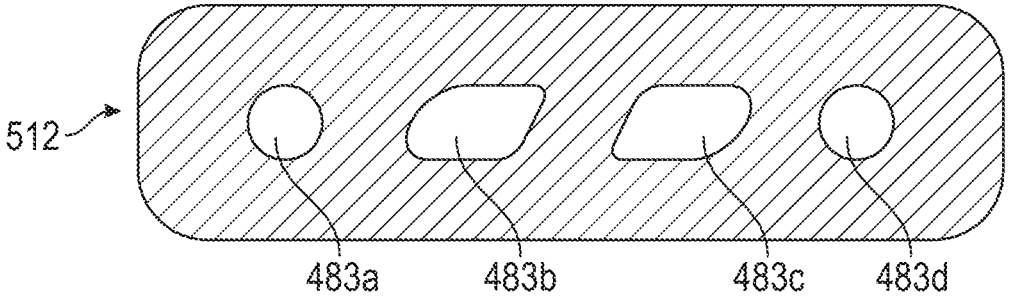
FIG. 5 is a cross section of the cooled turbine blade taken along the line 5-5 of FIG. 4.

FIG. 5 is a cross section of the cooled turbine blade taken along the line 5-5 of FIG. 4. The channels 483 can have a serial arrangement 512 chord wise along the blade root 480 at the cooling air inlet 481 proximate the blade root 480. As the cooling air passageway 482 approaches the level of the platform 443, the channels 483 can redirect cooling air 15 within the multi-bend heat exchange path 470 via a transition arrangement 514 toward a parallel arrangement 516 chord wise to the blade root 480. The transition arrangement 514 is a portion of a series-to-parallel transition 490 and in other words within the series-to parallel-transition 490, described in connection with FIG. 9. The transition arrangement 514 may be disposed between the root end 444 and the base 442 distal from the root end 444.

Figure 6:
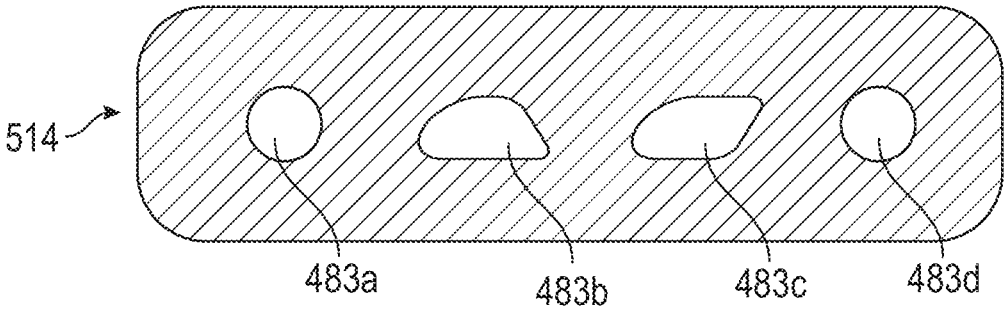
FIG. 6 is a cross section of the cooled turbine blade taken along the line 6-6 of FIG. 4.

FIG. 6 is a cross section of the cooled turbine blade taken along the line 6-6 of FIG. 4. As the cooling air flows through the cooling air passageway 482 in the transition arrangement 514, the channels 483*b*, 483*c* redirect the cooling air 15 into a parallel arrangement 516 (FIG. 7), where the first inner channel 483*b* and the second inner channel 483*c* are a side-by-side between the pressure side 448 and the lift side 449. The parallel arrangement 516 may include the first outer channel 483*c* disposed between the pressure side 448 and the lift side 449 and may include the second inner channel 483*c* disposed between the first inner channel 483*b* and the lift side 449. During the series to parallel transition 490, one or more of channels 483 may change shape, angle, orientation, and sequence in which they are positioned to one another chord wise to the blade root 480. In an embodiment, the first inner channel 483*b* may be disposed closer to the aft face 487 than the forward face 486 proximate the platform 443 and the second inner channel 483*c* maybe be disposed closer to the aft face 487 than the forward face 886 proximate the platform 443. One or more of the channels 483 may include a bend, twist, curve, or flex during the series to parallel transition 490.

In an embodiment the first inner channel 483*b* and second inner channel 483*c* may include cross sectional areas that vary from throughout the base, when viewed from the root end 444 towards the tip end 445. The first inner channel 483*b* may curve towards the pressure side 448 as the first inner channel 483*b* extends from the cooling air inlet 481 towards the tip end 445 and the second inner channel 483*c* may curve towards the lift side 449 as the second inner channel 483*c* extends from the cooling air inlet 481 towards the tip end 445. The second inner channel 483*c* may twist as it extends from the cooling air inlet 481 towards the platform 443. The first inner channel 483*b* may be disposed adjacent the pressure side 448 of the inner spar 462. The second inner channel 483*c* may be disposed adjacent the lift side 449 of the inner spar 462.

Figure 7:
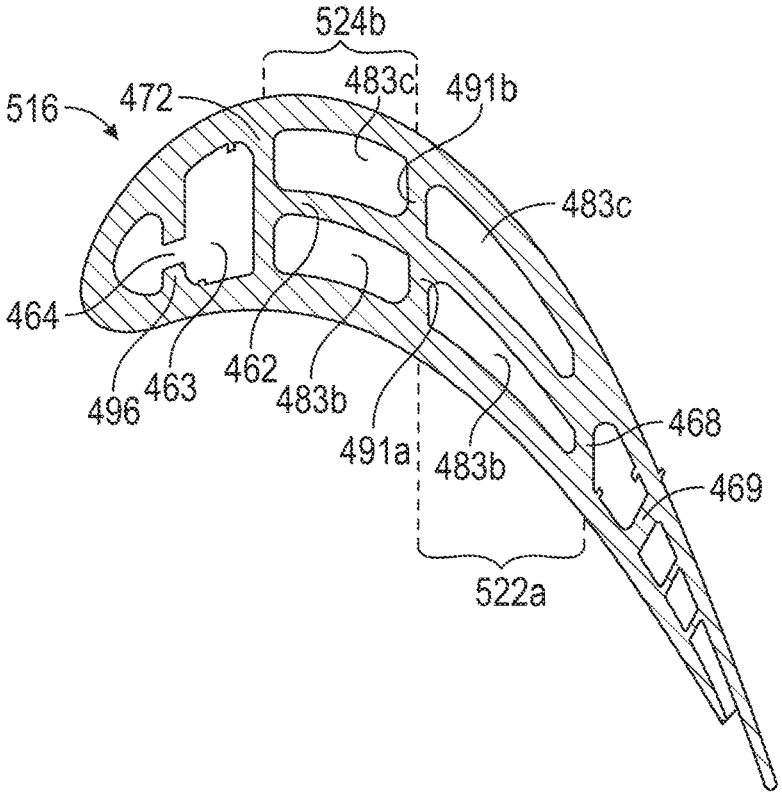
FIG. 7 is a cross section of the cooled turbine blade taken along the line 7-7 of FIG. 4.

FIG. 7 is a cross section of the cooled turbine blade taken along the line 7-7 of FIG. 4. The parallel arrangement 516 provides side-by-side first inner channel 483*b* and second inner channel 483*c*, separated by the inner spar 462, to channel cooling air 15 radially outward in a pressure side trailing edge section 522*a* toward the tip end 445, for example. In an embodiment, the first inner channel 483*b* and second inner channel 483*c* can have similar cross-sectional areas proximate the leading edge rib 472. The cooling air 15 can be redirected within the cooling air passageway 482 in the pressure side upper turning vane bank 501*a* (FIG. 10) proximate the tip end 445. The pressure side trailing edge section 522*a* of the first inner channel 483*b* can be separated from a pressure side leading edge section 524*a* by the pressure side inner spar rib 491*a*. A lift side trailing edge section 522*b* of the second inner channel 483*c* can be separated from a lift side leading edge section 524*b* by a lift side inner spar rib 491*b*. The cooling air 15 can then flow radially inward in a pressure side leading edge section 524*a* within the airfoil 441 away from the tip end 445 toward the lower turning vane bank 551 (FIG. 11). The lower turning vane bank 551 can redirect the cooling 15 radially outward toward the tip end 445 into the leading edge chamber 463. As described in more detail below, the lower turning vane bank 551 can include a parallel-to-series transition, redirecting the first inner channel 483*b* and second inner channel 483*c* from parallel channels to a single channel within the leading edge chamber 463.

Figure 8:
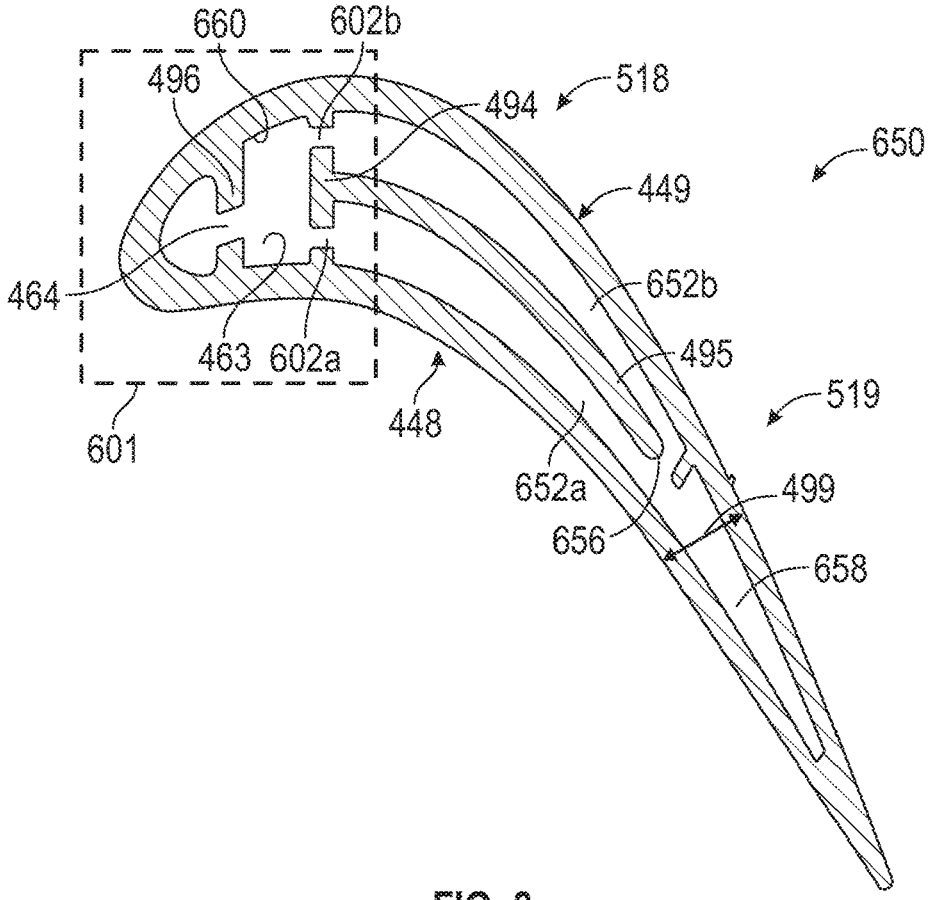
FIG. 8 is a cross section of the cooled turbine blade taken along the line 8-8 of FIG. 4.

FIG. 8 is a cross section of the cooled turbine blade taken along the line 8-8 of FIG. 4. As the cooling air 15 approaches the tip end 445 within the leading edge chamber 463, at least a portion of the cooling air 15 enters the tip diffuser 601. The tip diffuser 601 includes a series-to-parallel transition that redirects the cooling air 15 from the single flow path within the leading edge chamber 463 to diffuser outputs 602 that may be parallel with respect to the mean camber line 474. In an embodiment, the diffuser outputs 602 may include a first diffuser output 602*a* and a second diffuser output 602*b* and may be in flow communication with the leading edge chamber 463. The first diffuser output 602*a* is disposed closer to the pressure side 448 than the lift side 449. The second diffuser output 602*b* is disposed closer to the lift side 449 than the pressure side 448. Tip flag channels 652 (including a tip flag pressure side channel 652*a* and tip flag lift side channel 652*b*) are in flow communication with the diffuser outputs 602 and are within the tip flag cooling system 650. The tip diffuser 601 may also include part of a flag spar 495. The flag spar 495 extends from the diffuser flag wall 494 towards the trailing edge 447 and may act as a wall or divider, separating the air flow from the tip flag pressure side channel 652*a* and tip flag lift side channel 652*b*. The flag spar 495 may extend along a portion of the mean camber line 474. The flag spar 495 may extend from between the first diffuser output 602*a* and second diffuser output 602*b*. Some features are not shown for clarity (e.g. the flag spar cooling fins 567).

The tip flag cooling system 650 includes the flag spar 495, and parallel tip flag channels 652. In an embodiment, the flag spar 495 may bifurcate the space between the lift side 449 and the pressure side 448 of the skin 460, radially outward of the inner spar cap 492, and radially inward of the tip wall 461, and may define the parallel tip flag channels 652. The parallel tip flag channels 652 may include the tip flag pressure side channel 652*a* and the tip flag lift side channel 652*b*. The tip flag pressure side channel 652*a* may be defined by the diffuser flag wall 494, the flag spar 495, the tip wall 461, the inner spar cap 492, and the pressure side 448. The tip flag lift side channel 652*b* (FIG. 15) may be defined by the diffuser flag wall 494, the flag spar 495, the tip wall 461, the inner spar cap 492, and the lift side 449. The tip flag pressure side channel 652*a* and the tip flag lift side channel 652*b* can define a parallel arrangement 518 that directs cooling air 15 towards a tip diffuser trailing edge 656.

The flag spar 495 may include the tip diffuser trailing edge 656. The tip diffuser trailing edge 656 may be distal from the diffuser flag wall 494. The tip diffuser trailing edge 656 may be the transition from the parallel arrangement 518 to a serial arrangement 519 and may be where the channels 652 converge from channels 562 to a single serial channel of the tip flag output channel 658.

The tip flag cooling system 650 may also include the tip flag output channel 658. The tip flag output channel 658 can be defined by the area between the tip diffuser trailing edge 656, the inner spar cap 492, the tip wall 461, the lift side 449, the pressure side 448, and the trailing edge 447. The tip flag output channel can define the serial arrangement 519 can may be in flow communication with the channels 652.

The tip flag output channel 658 can decrease in camber width 499 approaching an area proximate the trailing edge 447. In this sense, the camber width 499 is a distance from the pressure side 448 to the lift side 449. FIG. 9 is a cutaway perspective view of a portion of the turbine blade of FIG. 3. FIG. 9 is a graphical representation and is not necessarily drawn to scale. Additionally, some features are not shown for clarity. As shown in FIG. 4 and FIG. 5, the cooling air 15 can enter the blade root 480 through the cooling air inlet 481 into the channels 483. The cooling air inlet 481 may include the first outer channel cooling air inlet 481*a*, the first inner channel cooling air inlet 481*b*, the second inner channel cooling air inlet 481*c*, and the second outer channel cooling air inlet 481*d*. The channels 483 may include a first outer channel 483*a*, a first inner channel 483*b*, a second inner channel 483*c*, and a second outer channel 483*d*. The channels 483 can have the series arrangement 512 (FIG. 5) at the beginning of the cooling air passageway 482. The "serial" disposition can be arranged generally along the blade root 480. This can also substantially coincide with the forward and aft direction of the center axis 95 when the cooled turbine blade is installed in a turbine engine, for example. The series arrangement 512 can gradually redirect the cooling air 15 via the transition arrangement 514 (FIG. 6) into the parallel arrangement 516 (FIG. 7), where the first inner channel 483*b* and second inner channel 483*c* are side by side when viewed from the leading edge 446 to the trailing edge 447. The cross section lines 6-6 and 7-7 are repeated in this figure showing the approximate locations of the transition arrangement 514 (FIG. 6) and the parallel arrangement 516 (FIG. 7) for the channels 483.

In an embodiment, the base 442 may include a first inner channel transition section 511 and a second inner channel transition section 513. The first inner channel transition section 511 can be disposed within the base 442. The first inner channel transition section 511 may include a curving, bending, twisting, or flexing portion of the first inner channel 483*b*.

The second inner channel transition section 513 can be disposed within the base 442. The second inner channel transition section 513 may include a curving, bending, twisting, or flexing portion of the second inner channel 483*c*.

In an embodiment there can by a first inner channel terminal end 515 disposed between the first inner channel transition section 511 and the tip end 445. The first inner channel terminal end 515 may include a portion of the first inner channel 483*b* that is disposed between the pressure side 448 of the skin 460 and the second inner channel 483*c*.

In an embodiment there can by a second inner channel terminal end 517 disposed between the second inner channel transition section 517 and the tip end 445. The second inner channel terminal end 517 may include a portion of the second inner channel 483*b* that is disposed between the lift side 449 of the skin 460 and the first inner channel 483*b*.

The series-to-parallel transition 490 twists or redirects the series flow of cooling air 15 at the cooling air inlet 481 into a parallel arrangement (e.g., the parallel arrangement 516). Given space constraints at the blade root 480, the channels 483 are disposed in series near the air inlet 481. However, the series-to-parallel transition 490 twists the channels to a parallel cooling flow in main core of the airfoil 441 and provides more rapid or efficient heat transfer than a single (series) cooling path. Hence, cooling air flows in series at the inlet 481 twists and redirects the cooling air 15 to form the parallel flow that continues toward the tip end 445. An advantage of the embodiments using parallel flow of the cooling air within the airfoil 441 is reduced pressure loss and increased fatigue life of the blade 440.

The cooling air inlet 481 may include the first outer channel cooling air inlet 481*a*, the first inner channel cooling air inlet 481*b*, the second inner channel cooling air inlet 481*c*, and the second outer channel cooling air inlet 481*d*. The channels 483 may include a first outer channel 483*a*, a first inner channel 483*b*, a second inner channel 483*c*, and a second outer channel 483*d*.

The first outer channel cooling air inlet 481*a* may be disposed between the forward face 486 and the first inner channel cooling air inlet 481*b*. The first inner channel cooling air inlet 481*b* may be disposed between the first outer channel cooling air inlet 481*a* and second inner channel cooling air inlet 481*c*. The second inner channel cooling air inlet 481*c* disposed between the first inner channel cooling air inlet 481*b* and second outer channel cooling air inlet 481*d*. The second outer channel cooling air inlet 481*d* may be disposed between the second inner channel cooling air inlet 481*c* and the aft face 487.

The first inner channel cooling air inlet 481*b* may also be described as being disposed between the second inner channel cooling air inlet 481*c* and the forward face 486. The second inner channel cooling air inlet 481*c* may also be described as being disposed between the first inner channel cooling air inlet 481*b* and the aft face 487.

The first outer channel 483*a* is in flow communication with the first outer channel cooling air inlet 481*a*, the first outer channel 483*a* may extend from the first outer channel cooling air inlet 481*a* towards the tip end 445. The first outer channel 483*a* can be disposed between the forward face 486 and first inner channel 483. The first outer channel 483*a* may be disposed closer to the leading edge 446 than the trailing edge 447 at the cooling air inlet 481 or the first outer channel cooling air inlet 481*a*. The first outer channel 483*a* may be disposed between the leading edge 446 and the first inner channel 483*b* at the first outer channel cooling air inlet 481*a*. The first outer channel 483*a* may be in flow communication with the leading edge chamber 463 and can be configured to redirect cooling air 15 from the first outer channel cooling air inlet 481*a* to the leading edge chamber 463 and may extend through a second turning bank wall 554 (FIG. 11).

The first inner channel 483*b* is in flow communication with the first inner channel cooling air inlet 481*b*. The first inner channel 483*b* may extend from the first inner channel cooling air inlet 481*b* towards the inner spar cap 492. The first inner channel 483*b* can be disposed closer to the forward face 486 than the aft face 487 adjacent the root end. The first inner channel 483*b* may be disposed closer to the leading edge 446 than the trailing edge 447 at the first inner channel cooling air inlet 481*b*. The first inner channel 483*b* can be disposed closer to the pressure side 447 than the lift side 446 proximate the platform 443. The first inner channel 483*b* can be configured to redirect cooling air 15 from the first inner channel cooling air inlet 481*b* to the pressure side trailing edge section 522*a*. The first inner channel 483*b* may include a portion that curves within the transition arrangement 514 towards the pressure side 448 of the skin 460 as the first inner channel 483*b* extends upwardly towards the airfoil 441. The first inner channel 483*b* may include a portion that curves towards the trailing edge 447 as the first inner channel 483*b* extends upwardly to the airfoil 441. The first inner channel 483*b* may include a portion that curves towards the trailing edge 447 as the first inner channel 483*b* extends upwardly to the airfoil 441.

In other words, the first inner channel 483*b* can be described as extending from the first inner channel cooling air inlet 481*b* towards the tip end 445 and may have a portion that curves with the first inner channel transition section 511 towards the pressure side 447 of the skin 460 as the first inner channel 483*b* extends upwardly towards the first inner channel terminal end 515. The first inner channel 483*b* may be in flow communication with the pressure side portion of the multi-bend heat exchange path 473. The first inner channel 483*b* may be described as being in flow communication with the pressure side trailing edge section 522*a*

The second inner channel 483*c* is in flow communication with the cooling air inlet 481. The second inner channel 483*c* may extend from the cooling air inlet 481 towards the tip end 445. The second inner channel 483*c* disposed between the forward face 486 and the aft face 487. The second inner channel 483*c* may be disposed between the first inner channel 483*b* and the trailing edge 447. The second inner channel 483*c* may be disposed closer to the trailing edge 447 than the leading edge 446 proximate the platform 443. The second inner channel 483*c* can be configured to redirect cooling air 15 from the cooling air inlet 481 to between the lift side inner spar rib 491*b* and the trailing edge rib 468, then subsequently redirect cooling air 15 between the lift side inner spar rib 491*b* and the leading edge rib 472. The second inner channel 483*c* may include a portion that curves within the transition arrangement 514 towards the lift side 449 of the skin 460 as the second inner channel 483*c* extends upwardly to the airfoil 441. The second inner channel 483*c* may include a portion that twists towards the leading edge 446 as the second inner channel 483*c* extends upwardly towards the airfoil 441. The second inner channel 483*c* may include a portion that curves towards the trailing edge 447, and a portion that is side by side with the first inner channel 483*b* and separated from the first inner channel 483*b* by the inner spar 462 as the second inner channel 483*c* extends upwardly towards the airfoil 441. The second inner channel 483*c* may be in flow communication with part of the multi-bend heat exchange path 470 adjacent the lift side 449 of the skin 460. The second inner channel 483*c* may be in flow communication with lift side trailing edge section 522*b* that can be defined by the lift side of the inner spar 462, the inner spar cap 492, the lift side inner spar rib 491*b*, the trailing edge rib 468, and the skin 460.

In other words the second inner channel 483*c* may be described as extending from the second inner channel cooling air inlet 481*c* towards the tip end 445 and may be disposed between the first inner channel 483*b* and aft face 487 adjacent the second inner channel cooling air inlet 481*c*. The second inner channel 483*c* may have a portion that curves within the second inner channel transition section 513 towards the lift side 449 of the skin 460 as the second inner channel 843*c* extends upwardly towards the second inner channel terminal end 517, The second inner channel 483*c* can be disposed between the first inner channel 483*b* and the lift side 449 at the second inner channel terminal end 517, The second inner channel 483*c* can be in flow communication with the lift side portion of the multi-bend heat exchange path 475. The second inner channel 483*c* may be described as being in flow communication with the lift side trailing edge section 522*b*.

The second outer channel 483*d* is in flow communication with the cooling air inlet 481. The second outer channel 483*d* may extend from the cooling air inlet 481 towards the tip end 445. The second outer channel 483*d* disposed between the forward face 486 and the aft face 487. The second outer channel 483*d* may be disposed between the second inner channel 483*c* and the trailing edge 447. The second outer channel 483*d* may be disposed closer to the trailing edge 447 than the leading edge 446 proximate the platform 443. The second outer channel 483*d* can be configured to redirect cooling air 15 from the cooling air inlet 481 to between the trailing edge rib 468 and the trailing edge 447, then subsequently redirect cooling air 15 between the lift side inner spar rib 491*b* and the leading edge rib 472.

The first inner channel 483*b* and the second inner channel 483*c* can be separated from the base 442 distal from the root end 444 towards the tip end 445 by the inner spar 462. A portion of the first inner channel 483*b* can curve towards the trailing edge 447 as the first inner channel 483*b* extends from the cooling air inlet 841 to towards the base 442 distal from the root end 444. A portion of the second inner channel 483*c* can twist towards the leading edge 446 as the second inner channel 483*c* extends from the cooling air inlet 841 to towards the base 442 distal from the root end 444. The first inner channel 483*b* and second inner channel 483*c* may have cross sectional areas that vary from disposed adjacent the root end 444 towards the airfoil 441, when viewed from the root end 444 towards the tip end 445.

FIG. 10 is a cutaway perspective view of a portion of the turbine blade of FIG. 3. The pressure side upper turning vane bank 501*a* is shown in dashed lines in FIG. 4. The pressure side upper turning vane bank 501*a* shown is related to the first inner channel 483*b*. Only the pressure side upper turning vane bank 501*a* for the channel 483*b* is shown in this view, as the upper turning vane bank for the channel 483*c* (e.g., on the lift side 449) is obscured. In some embodiments, similar features may exist on the lift side 446 in similar arrangement as shown in FIG. 10.

The pressure side upper turning vane bank 501*a* can have a pressure side first turning vane 502*a*, a pressure side second turning vane 504*a*, a pressure side third turning vane 506*a*, a pressure side first corner vane 508, and a pressure side second corner vane 510*a*. The pressure side first turning vane 502*a*, the pressure side second turning vane 504*a*, and the pressure side third turning vane 506*a* can be the same or similar to the at least one turning vane 465 described above in connection with FIG. 4. Additionally, the pressure side first corner vane 508, and the pressure side second corner vane 510*a* can be the same or similar to the one or more air deflector(s) 466 described above in connection with FIG. 4.

The pressure side first turning vane 502*a* may extend from the inner spar 462 to the skin 460. The pressure side first turning vane 502*a* may also extend from the pressure side leading edge section 524*a* closer to the base 442 than the pressure side inner spar rib outward end 493*a*, to between the pressure side inner spar rib outward end 493*a* and the inner spar cap 492, and to the pressure side trailing edge section 522*a* closer to the base 442 than the pressure side inner spar rib outward end 493*a*. The pressure side first turning vane 502*a* may also be described as extending continuously from the pressure side leading edge section 524*a* to the pressure side trailing edge section 522*a*, including a portion of the pressure side first turning vane 502*a* disposed in the pressure side leading edge section 524*a* closer to the base 442 than the pressure side inner spar rib outward end 493*a*, a portion of the pressure side first turning vane 502*a* disposed in the pressure side trailing edge section 522*a* closer to the base 442 than the pressure side inner spar rib outward end 493*a*, and a portion of the pressure side first turning vane 502*a* disposed between the pressure side inner spar rib outward end 493*a* and the inner spar cap 492.

The pressure side first turning vane 502*a* and the pressure side second turning vane 504*a* can have a semi-circular shape that spans approximately 180 degrees. The pressure side third turning vane 506*a* can span an angle 503. The angle 503 can be approximately 120 degrees. Each of the pressure side first turning vane 502*a*, the pressure side second turning vane 504*a*, and the pressure side third turning vane 506*a* can have an even or symmetrical curvature. In some other embodiments, one or more of the pressure side first turning vane 502*a*, the pressure side second turning vane 504*a*, and the pressure side third turning vane 506*a* can have an asymmetrical curvature.

The pressure side second turning vane 504*a* may extend from the inner spar 462 to the skin 460. The pressure side second turning vane 504*a* may also extend from the pressure side leading edge section 524*a* closer to the base 442 than the pressure side inner spar rib outward end 493*a*, to between the pressure side inner spar rib outward end 493*a* and the inner spar cap 492, and to the pressure side trailing edge section 522*a* closer to the base 442 than the pressure side inner spar rib outward end 493*a*. The pressure side second turning vane 504*a* may also be described as extending continuously from the pressure side leading edge section 524*a* to the pressure side trailing edge section 522*a*, including a portion of the pressure side second turning vane 504*a* disposed in the pressure side leading edge section 524*a* closer to the base 442 than the pressure side inner spar rib outward end 493*a*, a portion of the pressure side second turning vane 504*a* disposed in the pressure side trailing edge section 522*a* closer to the base 442 than the pressure side inner spar rib outward end 493*a*, and a portion of the pressure side second turning vane 504*a* disposed between the pressure side inner spar rib outward end 493*a* and the inner spar cap 492.

The pressure side third turning vane 506*a* may extend from the inner spar 462 to the skin 460, the pressure side third turning vane 506*a* disposed between the pressure side second turning vane 504*a* and the inner spar cap 492.

The pressure side first turning vane 502*a*, the pressure side second turning vane 504*a*, and the pressure side third turning vane 506*a* can each have a vane width 505. For example, in the embodiment shown, the vane width 505 can be the dimension between an edge of a vane disposed radially closest to the pressure side inner spar rib outward end 493*a* and a second edge of the same vane radially furthest to the pressure side inner spar rib outward end 493*a*. In the embodiment shown, the vane width 505 is a uniform width along the entire curvature of the pressure side first turning vane 502*a*, the pressure side second turning vane 504*a*, and the pressure side third turning vane 506*a*. In some other embodiments, the pressure side first turning vane 502*a*, the pressure side second turning vane 504*a*, and the pressure side third turning vane 506*a* have non uniform vane width 505. The pressure side first turning vane 502*a* can be separated or displaced from the pressure side second turning vane 504*a* by a first vane spacing 507. The pressure side second turning vane 504*a* can be separated from the pressure side third turning vane 506*a* by a second vane spacing 509. In some embodiments, the first vane spacing 507 and the second vane spacing 509 can be approximately two times the vane width 505 (e.g., 2:1 ratio). In some embodiments, the first vane spacing 507 can be different from the second vane spacing 509. For example, the first vane spacing 507 can be two times the vane width 505 and the second vane spacing 509 can be two to three times the vane width 505. In some embodiments, the spacing-to-width ratio can also be higher, for example having a 2:1, 3:1, or 4:1 spacing-to-width ratio, for example. The first vane spacing 507 and the second vane spacing 509 do not have to be equivalent. The first vane spacing 507 and the second vane spacing 509 can also be the same, or equivalent.

The pressure side first corner vane 508 and the pressure side second corner vane 510*a* can be spaced approximately 90 degrees apart, with respect to the turning vanes. The pressure side first corner vane 508 and the pressure side second corner vane 510*a* can also have an aerodynamic shape having a chord length to width ratio of approximately 2:1 to 3:1 ratio. The pressure side first corner vane 508 and the pressure side second corner vane 510*a* have sizes and positions selected to maximize cooling in a pressure side leading corner 526*a* and a pressure trailing corner 528*a*. The pressure side first corner vane 508*a* and the pressure side second corner vane 510*a* may be configured to redirect cooling air 15 flowing near the inner spar cap 492 towards the base 442. The size, arrangement, shape of the pressure side first corner vane 508*a* and the pressure side second corner vane 510*a* and their respective separation or distance from the turning vanes 502, 504, 506, are selected to optimize cooling effectiveness of the cooling air 15 and increase fatigue life of the cooled turbine blade 440. The cooling air 15 can move through the pressure side upper turning vane bank 501*a* with a minimum loss of pressure and in a smooth manner. This can reduce the presence of dead spots, leading to more uniform cooling for the cooled turbine blade 440.

The pressure side upper turning vane bank 501*a* can also have one or more turbulators 530. The turbulators 530 can be formed as ridges on the inner spar 462. The turbulators 530 can be positioned between the turning vanes 502, 504, 506 in various locations. The turbulators 530 can interrupt flow along the inner spar 462 and prevent formation of a boundary layer which can decrease cooling effects of the cooling air 15. The pressure side upper turning vane bank 501*a* can have one or more turbulators 530 below the pressure side first turning vane 502*a*. One turbulators 530 is shown below the pressure side first turning vane 502*a* in FIG. 10. Three turbulators 530 are shown between the pressure side first turning vane 502*a* and the pressure side second turning vane 504*a*. In some embodiments more or turbulators 530 may be present between the pressure side first turning vane 502*a* and the pressure side second turning vane 504*a*. Two turbulators 530 are shown between the pressure side second turning vane 504*a* and the pressure side third turning vane 506*a*. However, in some embodiments more or fewer turbulators 530 may be present between the pressure side second turning vane 504*a* and the pressure side third turning vane 506*a*.

The size, arrangement, shape of the turning vanes 502, 504, 506 and their respective separation or distance between the vanes, are selected to optimize cooling effectiveness of the cooling air 15 and increase fatigue life of the cooled turbine blade 440. The cooling air 15 can move through the pressure side upper turning vane bank 501*a* with a minimum loss of pressure and in a smooth manner. Turning vanes 502, 504, 506 may be configured to redirect cooling air 15 flowing toward the inner spar cap 492 in the pressure side trailing edge section 522*a* and turn the cooling air 15 into the pressure side leading edge section 524*a*. Turning vanes 502, 504, 506 may also be described as configured to redirect cooling air 15 flowing toward the inner spar cap 492 in the pressure side trailing edge section 522*a* toward the base 442

FIG. 11 is a cutaway perspective view of a portion of the turbine blade of FIG. 3. The cooling air 15 flows radially inward (e.g., in the pressure side leading edge section 524*a* of FIG. 7) away from the pressure side upper turning vane bank 501*a* in both the first inner channel 483*b* and the second inner channel 483*c*, separated by the inner spar 462. The cooling air 15 in both the channels 483*b*, 483*c* is then routed radially inward toward the lower turning vane bank 551. The turbine blade 440 shown in FIG. 11 generally depicts the features visible from the pressure side 447. However, in some embodiments, similar features may exist on the lift side 446 in similar arrangement as shown in FIG. 11.

The first inner channel 483*b* and second inner channel 483*c* in the pressure side leading edge section 524*a* are in a parallel arrangement, flowing radially inward toward the blade root 480. The lower turning vane bank 551 can have at least one turning vane 552 that redirects the cooling air 15 into the leading edge chamber 463. Accordingly, the parallel arrangement of the first inner channel 483*b* and second inner channel 483*c* converges into the leading edge chamber 463 as a single, serial channel flowing radially outward toward the tip end 445. The first inner channel 483*b* may include the area between the pressure side 448 of the inner spar 462, the leading edge rib 472, the pressure inner spar 491, and the skin 460. The second inner channel 483*c* may include the area between the lift side 449 of the inner spar 462, the leading edge rib 472, the lift side inner spar rib 491*b*, and the skin 460. The first inner channel 483*b* and the second inner channel 483*c* may be in parallel arrangement 516 along the mean camber line 474.

The turning vane 552 may extend from the lift side 449 to the pressure side 448. Furthermore, the turning vane 552 may extend from the pressure side leading edge section 524*a* closer to the tip end 445 than the leading edge rib inward end 498, to between the leading edge rib inward end 498 and the blade root 480, and to the leading edge chamber closer 463 to the tip end 445 than the leading edge rib inward end 498. The turning vane 552 may be configured to redirect cooling air 15 moving towards the blade root 480 from the pressure side leading edge section 524*a* and the lift side leading edge section 524*b* (FIG. 14) and turn the cooling air 15 into the leading edge chamber 463. In other words, the turning vane 552 may be configured to redirect cooling air 15 moving towards the blade root 480 from the first inner channel 483*b* and second inner channel 483*c* and turn the cooling air 15 into the leading edge chamber 463.

The turning vane 552 can have a symmetrical curve, spanning approximately 180 degrees. In some embodiments, the turning vane 552 can alternatively have an asymmetrical curve. The turning vane has a uniform vane width along a curvature of the turning vane 552. The lower turning vane bank 551 can also have a second turning bank wall 554 that has a similar curvature as the turning vane 552. However, the curvature of the second turning bank wall 554 and the turning vane 552 do not have to be the same. The spacing between the turning vane 552 and the second turning bank wall 554 provides a smooth path for the cooling air 15. This can reduce and prevent hotspots on the second turning bank wall 554 and other adjacent components.

The turning vane 552 can be separated or otherwise decoupled from the inner spar 462 and the leading edge rib 472, for example. The inner spar 462 can further have a cutout 558 that provides a separation from the turning vane 552. In an embodiment, the cutout 558 may be a semicircular shape that is removed from the inner spar 462. The cutout 558 may be disposed distal from the tip end 445 and proximate the leading edge rib 472. The cutout 558 and separation between the turning vane 552 and the leading edge rib 472, for example, can prevent or reduce hotspots and increase fatigue life of the cooled turbine blade 440. The size, number, spacing, shape and arrangement of the turning vanes 552 in the lower turning vane bank 551 can vary and is not limited to the one shown. Multiple turning vanes 552 can be implemented.

FIG. 12 is a cutaway perspective view of a portion of the turbine blade of FIG. 3. The cooling air 15 can follow the multi-bend heat exchange path 470 past the lower turning vane bank 551 and flow radially outward in the leading edge chamber 463. The leading edge chamber 463 can have a plurality of perforations 464 that provide a flow path for the cooling air 15. A portion of the cooling air 15 may flow through the perforations 464 and out cooling holes 497 along the leading edge 446 of the cooled turbine blade 440.

The cooling air 15 can then flow from the leading edge chamber 463 in a series flow into the tip diffuser 601. The tip diffuser 601 includes a diffuser box 660 and diffuser outputs 602. The tip diffuser 601 may refer to the area depicted in FIG. 12 proximate the tip end 445 and the leading edge 446. The tip diffuser 601 can be in flow communication with and receive the cooling air 15 from the leading edge chamber 463. The tip diffuser 601 may also include a diffuser flag wall 494 and a leading edge wall 496. In an embodiment, the diffuser flag wall 494 may extend from the pressure side 448 to the lift side 449 and may extend from the tip wall 461 to the inner spar cap 492. In another embodiment, the leading edge rib 472 may extend to the tip wall 461, in which the diffuser flag wall 494 is a portion of the leading edge rib 472. The leading edge wall 496 may extend from the tip wall 461 towards the blade root 480 and may divide the leading edge chamber 463. The leading edge wall 496 may include the perforations 464 to provide a flow path for the cooling air 15.

The diffuser box 660 may be in flow communication with the leading edge chamber 463. The diffuser box 660 may be defined by the inner spar cap 492, the lift side 449, the pressure side 448, the tip wall 461, the diffuser flag wall 494, and the leading edge wall 496. The tip diffuser 601 can be in flow communication with and direct the cooling air 15 through diffuser outputs 602 and subsequently into parallel tip flag channels 652 (labeled individually tip flag channels 652*a*, 652*b*). The diffuser outputs 602 can be referred to as a first diffuser output 602*a* and a second diffuser output 602*b*. The first diffuser output 602*a* can be defined by an opening in the diffuser flag wall 494. Similarly, the tip flag channels 652 may be referred to individually as a tip flag pressure side channel 652*a* and a tip flag lift side channel 652*b* each coupled to a respective one of the diffuser outputs 602. The tip flag channels 652 may be defined by the area between the diffuser flag wall 494, the skin 460, the inner spar cap 492, the tip wall 461 and the flag spar 495 (as can be seen in FIG. 13). The tip flag lift side channel 652*b* is not fully visible due to the aspect of the figure. In some embodiments, similar features may exist on the lift side 446 in similar arrangement as shown in FIG. 12.

In some examples, other cooling mechanisms and the path of the cooling air 15 may not maximize cooling at the leading edge 446. In addition, discharge of the cooling 15 air to parallel tip flag channels can also be low. This can lead to pressure losses and decreased fatigue life of the blade 440.

The tip diffuser 601 can act as a collector positioned at the leading edge chamber 463. The tip diffuser 601 can have diffuser box 660 having a U-shaped cross section as viewed along the mean camber line 474, with the bottom of the "U" disposed proximate the tip end 445. The U-shaped portion can accumulate the maximum cooling air 15 from the leading edge chamber 463. This cooling air can be redirected to the parallel tip flag channels 652 tip of the tip flag cooling system 650. The cooling air 15 can have radial flow and axial flow from multiple sources that combine at the tip diffuser 601. For example, the axial flow can be collected from the leading edge chamber 463 and the radial flow can be collected from the cooling air 15 flowing directly through the leading edge 446. The curvature of the diffuser box 660 provides collecting of the cooling air 15, redirection to parallel axial flow to the tip flag channels 652, and impingement cooling of the tip end 445 at a tip edge 662 of the diffuser box 660. At the same time, the cooling air 15 can cool the area around the tip diffuser 601 and the flow through the diffuser outputs 602.

FIG. 13 is a cutaway perspective view of a portion of the turbine blade of FIG. 3. The cooling air 15 can exit the tip diffuser 601 through the diffuser outputs 602 into the tip flag cooling system 650. The tip flag cooling system 650 can have the parallel tip flag channels 652. However, only the tip flag pressure side channel 652*a* is shown in this view due to aspect. The features of the tip flag lift side channel 652*b* may be the same or similar as the tip flag pressure side channel 652*a*. FIG. 8 shows the tip flag lift side channel 652*b* in a tip-down cross section of the parallel flow pattern of the tip flag channels 652. The turbine blade 440 shown in FIG. 13 generally depicts the features visible from the pressure side 447. However, in some embodiments, similar features may exist on the lift side 446 in similar arrangement as shown in FIG. 13.

The tip flag channels 652 extend from the tip diffuser 601 along the pressure side 448 and the lift side 449 and join at a tip diffuser trailing edge 656. The tip flag channels 652*a*, 652*b* rejoin at the tip diffuser trailing edge 656 and form the tip flag output channel 658 (see also FIG. 8). This arrangement then forms a parallel-to-series flow as depicted in FIG. 8. The series flow through the tip flag output channel 658 can eject the cooling air 15 via the cooling air outlets 471 in the trailing edge 447.

The tip flag output channel 658 can increase is height from the tip diffuser trailing edge 656 to the trailing edge 447. For example, the tip flag output channel 658 can have a height 664 proximate the tip diffuser trailing edge 656. The tip flag output channel 658 can have a height 666 proximate the trailing edge 447. The height 666 can be greater than the height 664. Thus, as the tip flag output channel 658 narrows from the pressure side 448 to the lift side 449 and the height increases, the mass flow of the cooling air 15 through the tip flag cooling system 650 can remain generally constant, except for film cooling holes (not shown) that penetrate the pressure side 448 in the area of the tip flag cooling system 650. The film cooling holes may allow some cooling air 15 to escape through the pressure side 448 which can subtract off some of the cooling air 15.

The design of the tip flag cooling system 650 includes parallel to series cooling paths. The parallel paths of cooling air are joined to form an expanded series flow path. So, there is an expanded trailing edge cooling path. Such a pattern of cooling paths provide effective and efficient cooling of tip of turbine blade.

FIG. 14 is a cutaway perspective view of a portion of the turbine blade of FIG. 3. A lift side upper turning vane bank 501*b* shown is related to the second inner channel 483*c*. The lift side upper turning vane bank 501*b* can have a lift side first turning vane 502*b*, a lift side second turning vane 504*b*, a lift side third turning vane 506*b*, a lift side first corner vane 508*b*, and a lift side second corner vane 510*b*. The lift side first turning vane 502*b*, the lift side second turning vane 504*b*, and the lift side third turning vane 506*b* can be the same or similar to the at least one turning vane 465 described above in connection with FIG. 4. Additionally, the lift side first corner vane 508*b*, and the lift side second corner vane 510*b* can be the same or similar to the one or more air deflector(s) 466 described above in connection with FIG. 4.

The airfoil 441 may include a lift side inner spar rib 491*b*. The lift side inner spar rib 491*b* may be similar to the pressure side inner spar rib 491*a*, such that it may extend radially from an area proximate the base 442 toward the tip end 445, terminating prior to reaching the end of the inner spar 462 distal from the blade root 480. The lift side inner spar rib 491*b* may have a lift side inner spar rib outward end 493*b* that is distal from the blade root 480.

The lift side inner spar rib 491*b* may extend from the lift side 449 of the inner spar 462 toward the lift side 449 of the skin 460. In doing so, the lift side inner spar rib 491*b* may define a lift side trailing edge section 522*b* in conjunction with the trailing edge rib 468, the inner spar 462, and the skin 460 at the lift side 449 of the airfoil 441. The lift side trailing edge section 522*b* may be a portion of a second inner channel 483*c*. In other words, the lift side trailing edge section 522*b* may be defined by the lift side inner spar rib 491*b*, the trailing edge rib 468, the inner spar 462, the inner spar cap 492, and the skin 460 at the lift side 449 of the airfoil 441. At least a portion of the cooling air 15 leaving the lift side trailing edge section 522*b* may be redirected toward a lift side transition section 523*b*. Accordingly, the lift side trailing edge section 522*b* may form part of the multi-bend heat exchange pat 470 and the lift side portion of the multi-bend heat exchange path 475.

The lift side transition section 523*b* may be a portion of the second inner channel 483*c* and can be defined by the space confined by the inner spar cap 492, the trailing edge rib 468, the leading edge rib 472, and a plane extending from a lift side inner spar rib outward end 493*b*, perpendicular to the lift side inner spar rib 491*b* and extending to the trailing edge rib 468, leading edge rib 472, inner spar 462, and skin 460. The lift side transition section 523*b* can adjoin and be in flow communication with the lift side trailing edge section 522*b*. At least a portion of the cooling air 15 leaving the lift side transition section 523*b* may be redirected toward the lift side leading edge section 524*b*. Accordingly, the lift side transition section 523*b* may form part of the multi-bend heat exchange path 470 and the lift side portion of the multi-bend heat exchange path 475.

The lift side inner spar rib 491*b*, the leading edge rib 472, the inner spar 462, the inner spar cap 492, and the skin 460 at the lift side 449 of the airfoil 441, may define a lift side leading edge section 524*b*. The lift side leading edge section 524*b* may be a portion of the second inner channel 483*c*. In other words, the lift side leading edge section 524*b* may be located between the lift side inner spar rib 491*b*, the leading edge rib 472, the inner spar 462, and the skin 460 at the lift side 449 of the airfoil 441. The lift side leading edge section 524*b* can adjoin and be in flow communication with the lift side transition section 523*b*. At least a portion of the cooling air 15 leaving the pressure side leading edge section 524*a* may be redirected toward the leading edge chamber 463. Accordingly, the lift side leading edge section 524*b* may form part of the multi-bend heat exchange path 470 and the lift side portion of the multi-bend heat exchange path 475.

The lift side first turning vane 502*b* may extend from the inner spar 462 to the skin 460. The lift side first turning vane 502*b* may also extend from the lift side leading edge section 524*b* closer to the base 442 than the lift side inner spar rib outward end 493*b*, to between the lift side inner spar rib outward end 493*b* and the inner spar cap 492, and to a lift side trailing edge section 522*b* closer to the base 442 than the lift side inner spar rib outward end 493*b*. The lift side first turning vane 502*b* may also be described as extending continuously from a lift side leading edge section 524*b* to the lift side trailing edge section 522*b*, including a portion of the lift side first turning vane 502*b* disposed in the lift side leading edge section 524*b* closer to the base 442 than the lift side inner spar rib outward end 493*b*, a portion of the lift side first turning vane 502*b* disposed in the lift side trailing edge section 522*b* closer to the base 442 than the lift side inner spar rib outward end 493*b*, and a portion of the lift side first turning vane 502*b* disposed between the lift side inner spar rib outward end 493*b* and the inner spar cap 492.

The lift side first turning vane 502*b* and the lift side second turning vane 504*b* can have a semi-circular shape that spans approximately 180 degrees. Each of the lift side first turning vane 502*b*, the lift side second turning vane 504*b*, and a lift side third turning vane 506*b* can have an even or symmetrical curvature. In some other embodiments, one or more of the lift side first turning vane 502*b*, the lift side second turning vane 504*b*, and the lift side third turning vane 506*b* can have an asymmetrical curvature.

The lift side second turning vane 504*b* may extend from the inner spar 462 to the skin 460. The lift side second turning vane 504*b* may also extend from the lift side leading edge section 524*b* closer to the base 442 than the lift side inner spar rib outward end 493*b*, to between the lift side inner spar rib outward end 493*b* and the inner spar cap 492, and to the lift side trailing edge section 522*b* closer to the base 442 than the lift side inner spar rib outward end 493*b*. The lift side second turning vane 504*b* may also be described as extending continuously from the lift side leading edge section 524*b* to the lift side trailing edge section 522*b*, including a portion of the lift side second turning vane 504*b* disposed in the lift side leading edge section 524*b* closer to the base 442 than the lift side inner spar rib outward end 493*b*, a portion of the lift side second turning vane 504*b* disposed in the lift side trailing edge section 522*b* closer to the base 442 than the lift side inner spar rib outward end 493*b*, and a portion of the lift side second turning vane 504*b* disposed between the lift side inner spar rib outward end 493*b* and the inner spar cap 492.

The lift side third turning vane 506*b* may extend from the inner spar 462 to the skin 460, the lift side third turning vane 506*b* disposed between the lift side second turning vane 504*b* and the inner spar cap 492.

The lift side first corner vane 508*b* and the lift side second corner vane 510 can be spaced approximately 90 degrees apart, with respect to the turning vanes. The lift side first corner vane 508*b* and the lift side second corner vane 510*b* can also have an aerodynamic shape having a chord length to width ratio of approximately 2:1 to 3:1 ratio. The lift side first corner vane 508*b* and the lift side second corner vane 510*b* have sizes and positions selected to maximize cooling in a lift side leading corner 526*b* and a lift side trailing corner

528*b*. The lift side first corner vane 508*b* and the lift side second corner vane 510*b* may be configured to redirect cooling air 15 flowing near the inner spar cap 492 towards the base 442. The size, arrangement, shape of the first lift side corner vane 508*b* and the lift side second corner vane 510*b* and their respective separation or distance from the lift side turning vanes 502*b*, 504*b*, 506*b*, are selected to optimize cooling effectiveness of the cooling air 15 and increase fatigue life of the cooled turbine blade 440. The cooling air 15 can move through the lift side upper turning vane bank 501*b* with a minimum loss of pressure and in a smooth manner. This can reduce the presence of dead spots, leading to more uniform cooling for the cooled turbine blade 440.

The size, arrangement, shape of the lift side turning vanes 502*b*, 504*b*, 506*b* and their respective separation or distance between the vanes, are selected to optimize cooling effectiveness of the cooling air 15 and increase fatigue life of the cooled turbine blade 440. The cooling air 15 can move through the lift side upper turning vane bank 501*b* with a minimum loss of pressure and in a smooth manner. The lift side turning vanes 502*b*, 504*b*, and 506*b* may be configured to redirect cooling air 15 flowing toward the inner spar cap 492 in the lift side trailing edge section 522*b* and turns the cooling air 15 into the lift side leading edge section 524*b*.

Figure 15:
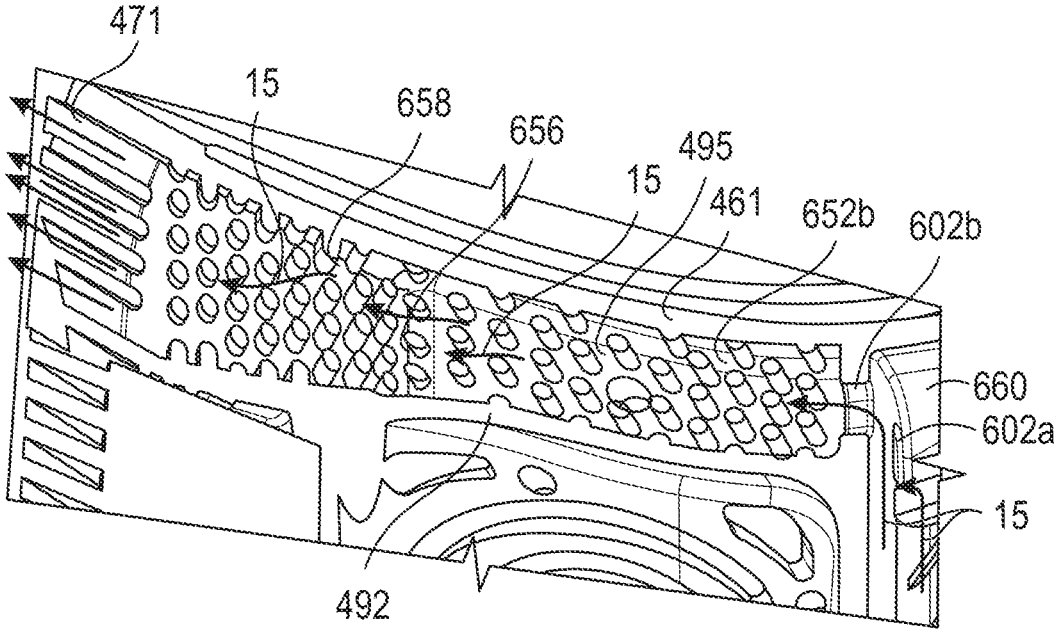
FIG. 15 is a cutaway perspective view of a portion of the turbine blade of FIG. 3.

FIG. 15 is a cutaway perspective view of a portion of the turbine blade of FIG. 3. The cooling air 15 can exit the tip diffuser 601 through the diffuser outputs 602 into the tip flag cooling system 650. The tip flag cooling system 650 can have the parallel tip flag channels 652. However, only the tip flag lift side channel 652*b* is shown in this view due to aspect. The features of the tip flag lift side channel 652*b* are similar to those in the pressure side tip flag channel 652*a*. FIG. 8 shows the tip flag lift side channel 652*b* in a tip-down cross section of the parallel flow pattern of the tip flag channels 652. The turbine blade 440 shown in FIG. 15 generally depicts the features visible from the lift side 446.

The tip flag channels 652 extend from the tip diffuser 601 along the pressure side 448 and the lift side 449 and join at a tip diffuser trailing edge 656. The tip flag channels 652*a*, 652*b* rejoin at the tip diffuser trailing edge 656 and form the tip flag output channel 658 (see also FIG. 8). This arrangement then forms a parallel-to-series flow as depicted in FIG. 8. The series flow through the tip flag output channel 658 can eject the cooling air 15 via the cooling air outlets 471 to the trailing edge 447.

The design of the tip flag cooling system 650 includes parallel to series cooling paths. The parallel paths of cooling air 15 are joined to form an expanded series flow path. So, there is an expanded trailing edge cooling path. Such a pattern of cooling paths provide effective and efficient cooling of tip of turbine blade 440.

INDUSTRIAL APPLICABILITY

The present disclosure generally applies to cooled turbine blades 440, and gas turbine engines 100 having cooled turbine blades 440. The described embodiments are not limited to use in conjunction with a particular type of gas turbine engine 100, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed cooled turbine blades 440 are applicable to the use, assembly, manufacture, operation, maintenance, repair, and improvement of gas turbine engines 100, and may be used in order to improve performance and efficiency, decrease maintenance and repair, and/or lower costs. In addition, embodiments of the presently disclosed cooled turbine blades 440 may be applicable at any stage of the gas turbine engine's 100 life, from design to prototyping and first manufacture, and onward to end of life. Accordingly, the cooled turbine blades 440 may be used in a first product, as a retrofit or enhancement to existing gas turbine engine, as a preventative measure, or even in response to an event. This is particularly true as the presently disclosed cooled turbine blades 440 may conveniently include identical interfaces to be interchangeable with an earlier type of cooled turbine blades 440.

As discussed above, the entire cooled turbine blade 440 may be cast formed. According to one embodiment, the cooled turbine blade 440 may be made from an investment casting process. For example, the entire cooled turbine blade 440 may be cast from stainless steel and/or a superalloy using a ceramic core or fugitive pattern. Accordingly, the inclusion of the inner spar 462 is amenable to the manufacturing process. Notably, while the structures/features have been described above as discrete members for clarity, as a single casting, the structures/features may pass through and be integrated with the inner spar 462. Alternately, certain structures/features (e.g., skin 460) may be added to a cast core, forming a composite structure.

Embodiments of the presently disclosed cooled turbine blades 440 provide for a lower pressure cooling air supply, which makes it more amenable to stationary gas turbine engine applications. In particular, the single bend provides for less turning losses, compared to serpentine configurations. In addition, the inner spar 462 and copious cooling fin 467 population provides for substantial heat exchange during the single pass. In addition, besides structurally supporting the cooling fins 467, the inner spar 462 itself may serve as a heat exchanger. Finally, by including subdivided sections of both the single-bend heat exchange path in the airfoil 441, and the cooling air passageway 482 in the base 442, the cooled turbine blades 440 may be tunable so as to be responsive to local hot spots or cooling needs at design, or empirically discovered, post-production.

The disclosed multi-bend heat exchange path 470 begins at the base 442 where pressurized cooling air 15 is received into the airfoil 441. The cooling air 15 is received from the cooling air passageway 482 and the channels 483 in a generally radial direction. The channels 483 are arranged serially at the blade root 480. As the cooling air 15 enters the base 442 the channels 483 are redirected from a serial arrangement into a parallel arrangement near the end of the airfoil 441 proximate the base 442. A parallel arrangement provides increased cooling effects of the cooling air 15 as it passes through the multi-bend heat exchange path 470 and past the inner spar cooling fins 467 and flag cooling fins 567.

The cooling air 15 follows the parallel first inner channel 483*b* and second inner channel 483*c* toward the pressure side upper turning vane bank 501*a*, which efficiently redirects the cooling air back toward the base 442 and the lower turning vane bank 551. The lower turning vane bank 551 has a turning vane 552 that redirects the cooling air 15 back in the direction of the tip end 445. The turning vane 552 also includes a parallel to series arrangement that directs the first inner channel 483*b* and second inner channel 483*c* into the leading edge chamber 463. The leading edge chamber 463 carries at least a portion of the cooling air 15 toward the tip end 445 while allowing a portion of the cooling air 15 to escape through the perforations 464 to cool the leading edge 446 of the cooled turbine blade 440.

As the cooling air 15 approaches the tip end 445 within the leading edge chamber 463, all or part of the cooling air can enter the tip diffuser 601. The tip diffuser 601 receives the cooling air 15 from the leading edge chamber 463, or main body serpentine (main body). The tip diffuser 601 includes a series to parallel flow transition as the cooling air 15 leaves the leading edge chamber 463 and impinges on the U-shaped diffuser box 660. The cooling air 15 can then be redirected toward the trailing edge 447 by tip wall 461 via the tip flag channels 562.

The tip flag channels 562 are parallel flow channels that take advantage of increased surface area for cooling the internal surfaces of the airfoil 441. The tip flag cooling system 650 also implements a parallel to series transition at the tip diffuser trailing edge 656. The output of the tip flag cooling system 650 narrows along the camber (e.g., from the pressure side 448 to the lift side 449) while increasing in height (measured span-wise) along the trailing edge 447. This can maintain a constant mass flow rate and constant pressure as the cooling air 15 leaves the tip flag cooling system 650 at the cooling air outlet 471.

The multi-bend heat exchange path 470 is configured such that cooling air 15 will pass between, along, and around the various internal structures, but generally flows in serpentine path as viewed from the side view from the blade root 480 back and forth toward and away from the tip end 445 (e.g., conceptually treating the camber sheet as a plane). Accordingly, the multi-bend heat exchange path 470 may include some negligible lateral travel (e.g., into and out of the plane) associated with the general curvature of the airfoil 441. Also, as discussed above, although the multi-bend heat exchange path 470 is illustrated by a single representative flow line traveling through a single section for clarity, the multi-bend heat exchange path 470 includes the entire flow path carrying cooling air 15 through the airfoil 441. With the implementation of the upper turning vane bank 501, the lower turning vane bank 551, the tip diffuser 601 and the tip flag cooling system 650, the multi-bend heat exchange path 470 makes use of the serpentine flow path with minimum flow losses otherwise associated with multiple bends. This provides for a lower pressure cooling air 15 supply.

In rugged environments, certain superalloys may be selected for their resistance to particular corrosive attack. However, depending on the thermal properties of the superalloy, greater cooling may be beneficial. Without increasing the cooling air supply pressure, the described method of manufacturing a cooled turbine blade 440 provides for increasingly dense cooling fin arrays, as the fins may have a reduced cross section. In particular, the inner spar cuts the fin distance half, allowing for the thinner extremities, and thus a denser cooling fin array. Moreover, the shorter fin extrusion distance (i.e., from the inner spar to the skin rather than skin-to-skin) reduces challenges to casting in longer, narrow cavities. This is also complementary to forming the inner blade core with the inner blade pattern as shorter extrusions are used.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein to mean including the method blocks or elements identified, but that such blocks or elements do not comprise an exclusive list and a method or apparatus may contain additional blocks or elements.

What is claimed is:

1. A turbine blade for use in a gas turbine engine, the turbine blade comprising:

a base including a root end, a forward face, an aft face distal from the forward face, a first inner channel cooling air inlet disposed proximate the root end, a second inner channel cooling air inlet disposed proximate the root end in series with the first inner channel cooling air inlet from the forward face to the aft face, a first inner channel transition section disposed within the base, and a second inner channel transition section disposed within the base;

an airfoil comprising a skin extending from the base and defining a leading edge, a trailing edge, a pressure side, and a lift side, including a tip end distal from the base, and a multi bend heat exchange path, having a pressure side portion of the multi-path heat exchange disposed adjacent the pressure side of the skin, and a lift side portion of the multi-path heat exchange disposed adjacent the pressure side of the skin;

a first inner channel terminal end disposed between the first inner channel transition section and the tip end;

a second inner channel terminal end disposed between the second inner channel transition section and the tip end;

a first inner channel extending from the first inner channel cooling air inlet towards the tip end, having a portion that curves within the first inner channel transition section towards the pressure side of the skin as the first inner channel extends upwardly towards the first inner channel terminal end, and is in flow communication with the pressure side portion of the multi bend heat exchange path;

a second inner channel extending from the second inner channel cooling air inlet towards the tip end, disposed between the first inner channel and aft face adjacent the second inner channel cooling air inlet, having a portion that curves within the second inner channel transition section towards the lift side of the skin as the second inner channel extends upwardly towards the second inner channel terminal end, the second inner channel disposed between the first inner channel and the lift side at the second inner channel terminal end, and is in flow communication with the lift side portion of the multi bend heat exchange path; and wherein within the base the first inner channel and the second inner channel transition their relative positions from the series arrangement of the first inner channel cooling inlet and the second inner channel cooling inlet to a parallel arrangement such that one of the inner channels is adjacent the pressure side and the other of the inner channels is adjacent the lift side and the inner channels are adjacent each other.

2. The turbine blade of claim 1, wherein the cooling turbine blade includes a first outer channel extending from proximate the root end towards the tip end, disposed between the forward face and the first inner channel.

3. The turbine blade of claim 2, wherein the cooling turbine blade includes a second outer channel extending from proximate the root end towards the tip end, disposed between the aft face and the second inner channel.

4. The turbine blade of claim 1, wherein the first inner channel include a portion that curves within the first inner channel transition section towards the trailing edge as the first inner channel extends upwardly towards the first inner channel terminal end.

5. The turbine blade of claim 1, wherein the second inner channel includes a portion that twists within the second inner channel transition section towards the trailing edge as the second inner channel extends upwardly towards the second inner channel terminal end.

6. The turbine blade of claim 1, wherein the first inner channel and second inner channel include cross sectional areas that vary within the base when viewed from the root end towards the tip end.

7. The turbine blade of claim 1, wherein the airfoil includes a mean camber line and an inner spar within the skin extending along the majority of the mean camber line, the inner spar extending from the base towards the tip end.

8. The turbine blade of claim 7, wherein the first inner channel and second inner channel are divided by the inner spar.

9. A turbine blade for use in a gas turbine engine, the turbine blade comprising:

a base including a root end, a platform distal from the root end, a forward face, an aft face distal from the forward face, a first inner channel cooling air inlet disposed proximate the root end, and a second inner channel cooling air inlet disposed proximate the root end in series with the first inner channel cooling air inlet from the forward face to the aft face;

an airfoil comprising a skin extending from the base and defining a leading edge, a trailing edge, a pressure side, and a lift side, having a tip end distal from the base, and a mean camber line;

a leading edge rib extending from the pressure side of the skin to the lift side of the skin, the leading edge rib extending from the base to proximate the tip end, proximal and spaced apart from the leading edge and within the skin, having a leading edge rib inward end distal from the tip end;

a trailing edge rib extending from the pressure side of the skin to the lift side of the skin, the trailing edge rib extending from the base to proximate the tip end, proximal and spaced apart from the trailing edge and within the skin;

an inner spar within the skin extending along a majority of the mean camber line, the inner spar extending from the base towards the tip end;

a pressure side inner spar rib extending from the pressure side of the inner spar to the pressure side of the skin, the pressure side inner spar rib disposed between the leading edge rib and the trailing edge rib;

a pressure side inner spar rib outward end distal from the base;

a lift side inner spar rib extending from the lift side of the inner spar to the lift side of the skin, the lift side inner spar rib disposed between the leading edge rib and the trailing edge rib;

a lift side inner spar rib outward end distal from the base;

an inner spar cap extending from the leading edge rib to the trailing edge rib, the inner spar cap extending from pressure side to the lift side, the inner spar cap disposed between the pressure side inner spar rib outward end and the tip end;

a pressure side trailing edge section formed by the pressure side inner spar rib, the pressure side of the inner spar, the trailing edge rib, and the pressure side of the skin;

a pressure side transition section adjoined to and in flow communication with the pressure side trailing edge section, formed by the pressure side inner spar rib outward end, the leading edge rib, the trailing edge rib, the inner spar cap, the inner spar, and pressure side of the skin; a pressure side leading edge section adjoined to and in flow communication with the pressure side transition section, formed by the pressure side inner spar rib, the leading edge rib, the pressure side of the skin, the inner spar, and proximate the leading edge inward end;

a lift side trailing edge section formed by the lift side inner spar rib, the lift side of the inner spar, the trailing edge rib, and the lift side of the skin;

a lift side transition section adjoined to and in flow communication with the lift side trailing edge section, formed by the lift side inner spar rib outward end, the leading edge rib, the trailing edge rib, the inner spar cap, the inner spar, and lift side of the skin;

a lift side leading edge section adjoined to and in flow communication with the lift side transition section, formed by the lift side inner spar rib, the leading edge rib, proximate the leading edge inward end, the lift side of the skin, and the inner spar, the lift side leading edge section converging with the pressure side leading edge section disposed proximate the leading edge inward end;

a first inner channel extending from the first inner channel cooling air inlet towards the inner spar cap and is in flow communication with the pressure side trailing edge section;

a second inner channel extending from the second inner channel cooling air inlet towards the inner spar cap, disposed between the first inner channel and the aft face adjacent the cooling air inlet and is in flow communication with the lift side trailing edge section; and wherein within the base the first inner channel and the second inner channel transition their relative positions from the series arrangement of the first inner channel cooling inlet and the second inner channel cooling inlet to a parallel arrangement such that one of the inner channels is adjacent the pressure side and the other of the inner channels is adjacent the lift side and the inner channels are adjacent each other.

10. The turbine blade of claim 9, wherein the second inner channel is disposed closer to the lift side of the skin than the pressure side of the skin proximate the platform.

11. The turbine blade of claim 10, wherein the first inner channel is disposed closer to the pressure side of the skin than the lift side of the skin proximate the platform.

12. The turbine blade of claim 9, wherein the first inner channel includes a portion that curves within the base towards the trailing edge as the first inner channel extends upwardly towards the airfoil.

13. The turbine blade of claim 9, wherein the second inner channel includes a portion that twists within the base towards the lift side of the skin as the second inner channel extends upwardly towards the airfoil.

14. The turbine blade of claim 9, wherein the first inner channel and second inner channel are divided by the inner spar.

15. A turbine blade for use in a gas turbine engine, the turbine blade comprising: a base including a root end, a platform distal from the root end, a first inner channel cooling air inlet disposed proximate the root end, a second inner channel cooling air inlet disposed proximate the root end in series with the first inner channel cooling air inlet from a forward face to an aft face distal from the forward face, an airfoil comprising a skin extending from the base and defining a leading edge, a trailing edge, a pressure side, and a lift side, having a tip end distal from the base;

a trailing edge rib extending from the pressure side of the skin to the lift side of the skin, the trailing edge rib extending from the base to proximate the tip end, proximal and spaced apart from the trailing edge and within the skin;

an inner spar within the skin extending from the trailing edge rib towards the leading edge, the inner spar extending from the base towards the tip end;

a pressure side inner spar rib extending from the pressure side of the inner spar to the pressure side of the skin, the pressure side inner spar rib disposed between the leading edge and the trailing edge rib;

a lift side inner spar rib extending from the lift side of the inner spar to the lift side of the skin, the lift side inner spar rib disposed between the leading edge and the trailing edge rib;

a pressure side trailing edge section formed by the pressure side inner spar rib, the pressure side of the inner spar, the trailing edge rib, and the pressure side of the skin;

a lift side trailing edge section formed by the lift side inner spar rib, the lift side of the inner spar, the trailing edge rib, and the lift side of the skin;

a first inner channel extending from the first inner channel cooling air inlet towards the tip end, having a portion that curves within the base towards the pressure side of the skin and towards the trailing edge as the first inner channel extends upwardly towards the airfoil, and is in flow communication with the pressure side trailing edge section; and a second inner channel extending from the second inner channel cooling air inlet towards the tip end, disposed between the first inner channel and aft face adjacent the second inner channel cooling air inlet, having a portion that twists within the base towards the lift side of the skin as the second inner channel extends upwardly towards the airfoil, the second inner channel disposed between the first inner channel and the lift side proximate the platform, and is in flow communication with the lift side trailing edge section; and wherein within the base the first inner channel and the second inner channel transition their relative positions from the series arrangement of the first inner channel cooling inlet and the second inner channel cooling inlet to a parallel arrangement such that one of the inner channels is adjacent the pressure side and the other of the inner channels is adjacent the lift side and the inner channels are adjacent each other.

16. The turbine blade of claim 15, wherein the first inner channel is disposed between the pressure side inner spar rib and the trailing edge rib as it extends toward the tip end.

17. The turbine blade of claim 15, wherein the second inner channel is disposed between the lift side inner spar rib and the trailing edge rib as it extends toward the tip end.

18. The turbine blade of claim 15, wherein the first inner channel is configured to redirect cooling air from the first inner channel cooling air inlet to the pressure side trailing edge section.

19. The turbine blade of claim 15, wherein the second inner channel is configured to redirect cooling air from the second inner channel cooling air inlet to the lift side trailing edge section.

20. The turbine blade of claim 15, wherein the cooling turbine blade includes a first outer channel disposed between the first inner channel and the forward face proximate the root end and includes a second outer channel disposed between the second inner channel and the aft face proximate the root end.

* * * * *